US010724272B2

(12) United States Patent
Cohen et al.

(10) Patent No.: US 10,724,272 B2
(45) Date of Patent: Jul. 28, 2020

(54) MECHANISM FOR A LOCKSET AND A METHOD FOR CONFIGURING A LOCKSET'S FUNCTION

(71) Applicant: TNBT HOLDINGS PTY LTD, Minchinbury (AU)

(72) Inventors: Marc Cohen, Bellevue Hill (AU); Daniel Mascia, North Parramatta (AU); Jonathon Woodcock, Bondi Junction (AU); Zsolt Szarka-Kovacs, Dee Why (AU)

(73) Assignee: TNBT HOLDINGS PTY LTD, Minchinbury (AU)

( * ) Notice: Subject to any disclaimer, the term of this patent is extended or adjusted under 35 U.S.C. 154(b) by 4 days.

(21) Appl. No.: 15/756,592

(22) PCT Filed: Sep. 2, 2016

(86) PCT No.: PCT/AU2016/050827
§ 371 (c)(1),
(2) Date: Mar. 1, 2018

(87) PCT Pub. No.: WO2017/035596
PCT Pub. Date: Mar. 9, 2017

(65) Prior Publication Data

US 2018/0187451 A1 Jul. 5, 2018

(30) Foreign Application Priority Data

Sep. 2, 2015 (AU) ..... 2015903590

(51) Int. Cl.
*E05B 17/04* (2006.01)
*E05B 55/06* (2006.01)
(Continued)

(52) U.S. Cl.
CPC ..... *E05B 17/044* (2013.01); *E05B 3/003* (2013.01); *E05B 3/065* (2013.01); *E05B 17/20* (2013.01);
(Continued)

(58) Field of Classification Search
CPC .... E05B 17/044; E05B 63/0056; E05B 3/065; E05B 55/06; E05B 55/005; E05B 3/003; E05B 63/04; E05B 17/20
(Continued)

(56) References Cited

U.S. PATENT DOCUMENTS 1,159,635 A * 11/1915 Wolfe et al. ..... E05B 59/00 70/107
2,976,073 A * 3/1961 Russell ..... E05B 3/003 292/352
(Continued)

FOREIGN PATENT DOCUMENTS

CN 203050282 U 7/2013

OTHER PUBLICATIONS

International Search Report dated Oct. 31, 2016 in related International Application No. PCT/AU2016/050827.
(Continued)

*Primary Examiner* — Lloyd A Gall
(74) *Attorney, Agent, or Firm* — Eric L. Lane; Green Patent Law

(57) ABSTRACT

Disclosed herein is a mechanism (30) for a lockset (10). The mechanism (30) comprises a latchbolt retractor (22) that is rotationally actuatable. The mechanism (30) comprises a rotationally mounted handle coupler (36). The rotationally mounted handle coupler (36) is rotatable by a rotation of a handle (12) when coupled thereto and comprises an adaptor receiver (46) for receiving any one of a plurality of adaptors (48,52,54). The rotationally mounted handle coupler is con-
(Continued)

figured to engage with at least one of the plurality of adaptors (48,52), but not all of the plurality of adaptors (54), for transmission of the rotation of the handle (12) to a latchbolt retractor actuator (22).

18 Claims, 22 Drawing Sheets

(51) Int. Cl.
*E05B 17/20* (2006.01)
*E05B 63/04* (2006.01)
*E05B 3/06* (2006.01)
*E05B 63/00* (2006.01)
*E05B 3/00* (2006.01)
*E05B 55/00* (2006.01)

(52) U.S. Cl.
CPC ..... *E05B 55/005* (2013.01); *E05B 55/06* (2013.01); *E05B 63/0056* (2013.01); *E05B 63/04* (2013.01)

(58) Field of Classification Search
USPC ..... 70/222, 223, 461, 462, 107, 422, 379 R, 70/379 A, 380, 472, 149, 218, 277, 278.7, 70/279.1, 283; 292/244, DIG. 27, 292/DIG. 60
See application file for complete search history.

(56) References Cited

U.S. PATENT DOCUMENTS 3,467,429 A * 9/1969 Armstrong ..... E05B 3/003 292/352
4,563,885 A * 1/1986 Madden ..... E05B 13/004 70/105
4,672,828 A * 6/1987 Theriault ..... E05B 63/0065 70/373
4,793,166 A 12/1988 Marks
5,481,890 A 1/1996 Millman
5,992,195 A 11/1999 Huang et al.
6,068,308 A * 5/2000 Molzer ..... E05B 13/10 292/336.3
6,305,727 B1 10/2001 Bland
6,581,423 B2 * 6/2003 Lin ..... E05B 47/0692 292/DIG. 27
6,640,593 B1 * 11/2003 Hannah ..... E05B 63/0056 70/224
6,993,945 B1 * 2/2006 Chen ..... E05B 13/101 292/DIG. 27
6,993,946 B1 * 2/2006 Shen ..... E05B 13/005 292/169.22
7,472,571 B1 * 1/2009 Chang ..... E05B 13/10 292/DIG. 27
8,079,238 B2 * 12/2011 Lin ..... E05B 55/06 292/169.22
8,555,685 B2 * 10/2013 Frolov ..... E05B 47/0673 292/137
10,260,254 B2 * 4/2019 Cohen ..... E05B 63/10
2009/0273440 A1 11/2009 Marschalek et al.
2010/0263418 A1 10/2010 Moon

OTHER PUBLICATIONS

Written Opinion dated Oct. 31, 2016 in related International Application No. PCT/AU2016/050827.
Office Action dated Mar. 10, 2020 in related European Patent Applicaiton No. 16 840 425.9.

* cited by examiner

| | INSIDE | | | | | | OUTSIDE | | | | | |
|---|---|---|---|---|---|---|---|---|---|---|---|---|
| | COMES | STATES | | OPERATIONS | | | COMES | STATES | | OPERATIONS | | |
| MODES | WITH | OPEN | LOCKED | OPENING WITH | LOCKING WITH | UNLOCKING WITH | WITH | OPEN | LOCKED | OPENING WITH | LOCKING WITH | UNLOCKING WITH |
| CLASSROOM | NA | YES | NA | HANDLE | NA | NA | CYL | YES | YES | HANDLE | KEY | KEY |
| VESTIBULE | NA | YES | NA | HANDLE | NA | NA | CYL | NA | YES | KEY | NA | NA |
| DOUBLE VESTIBULE | CYL | NA | YES | KEY | NA | NA | CYL | NA | YES | KEY | NA | NA |
| PRIVACY | PUSH BUTTON | YES | NA | HANDLE | NA | NA | COIN OPERATED TURN SNIB | YES | YES | HANDLE | PUSH BUTTON (on the inside) | INSIDE HANDLE / ANTI-LOCKOUT |
| ENTRANCE | PUSH BUTTON | YES | NA | HANDLE | NA | NA | CYL | YES | YES | HANDLE | PUSH BUTTON (on the inside) / KEY | INSIDE HANDLE / KEY / ANTI-LOCKOUT (opt) |
| PATIO | PUSH BUTTON | YES | NA | HANDLE | NA | NA | NA | YES | YES | HANDLE | PUSH BUTTON (on the inside) | INSIDE HANDLE / ANTI-LOCKOUT |
| GLASS DOOR | CYL | YES | YES | HANDLE | KEY | KEY | CYL | YES | YES | HANDLE | KEY | KEY |
| PASSAGE | NA | YES | NA | HANDLE | NA | NA | NA | YES | NA | HANDLE | NA | NA |

Figure 1

MECHANISM FOR A LOCKSET AND A METHOD FOR CONFIGURING A LOCKSET'S FUNCTION

TECHNICAL FIELD

The disclosure herein generally relates to a mechanism for a lockset and a method for configuring a lockset's function.

BACKGROUND

Locksets, including leversets, are commonly installed on hinged barriers including but not limited to doors and gates. Their ease of installation contribute to their popularity. There are some aspects of locksets, however, that are less than ideal.

A lockset may be bought having a predetermined lockset function that determines how a user interacts with the lockset. Generally, in each family of locksets there are only a limited number of ways of a user operating the a latch bolt, but numerous ways of preventing the user from operating the lockset's latch bolt. Some example functions known to locksmiths include:

entrance
vestibule
double vestibule
classroom
glass door
patio
privacy
passage

These functions are summarised in the table in FIG. 1. Currently, a single lockset may not be able to perform more than one function. Consequently, a locksmith may need to hold different locksets that have different functions. This requires the holding of more locksets then desirable, requiring significant amounts of capital and greater storage requirements. A locksmith may not have the space in his vehicle to carry different types of locksets and may be caught out without a lockset having the required function. It may not be possible to change the function of a lockset once installed, which would need replacing if a different function was required.

SUMMARY

Disclosed herein is a mechanism for a lockset. The mechanism comprises a latchbolt retractor that is rotationally actuatable. The mechanism comprises a rotationally mounted handle coupler. The rotationally mounted handle coupler is rotatable by a rotation of a handle when coupled thereto and comprises an adaptor receiver for receiving any one of a plurality of adaptors. The rotationally mounted handle coupler is configured to engage with at least one of the plurality of adaptors, but not all of the plurality of adaptors, for transmission of the rotation of the handle to a latchbolt retractor actuator.

Disclosed herein is a mechanism for a lockset. The mechanism comprises a latchbolt retractor that is rotationally actuatable. The mechanism comprises a pair of rotationally mounted handle couplers. Each of the pair is rotatable by a rotation of a handle when coupled thereto and comprise an adaptor receiver for receiving any one of a plurality of adaptors. Each of the pair is configured to engage with at least one of the plurality of adaptors, but not all of the plurality of adaptors, for transmission of the rotation of the handle to a latchbolt retractor actuator.

In an embodiment, the pair of rotationally mounted handle couplers are identical, however the pair of rotationally mounted handle couplers need not be.

In an embodiment, the plurality of adaptors comprises a clutch adaptor operable to engage an adaptor receiver of the pair while being received thereby for transmission of the rotation and operable to disengage the adaptor receiver of the pair while being received thereby.

In an embodiment, the clutch adaptor is operable to interlock with the adaptor receiver of the pair while being received thereby for transmission of the rotation of the handle.

In an embodiment, the adaptor receiver comprises a keyway, and the clutch adaptor comprises a retractable key and is operable to outwardly extend the retractable key into the keyway and to retract the retractable key from the keyway.

In an embodiment, the clutch adaptor comprises a bearing component on which the retractable key is mounted and a cam component configured to translate the retractable key along the bearing component when rotated relative to bearing component. The cam component may be configured to inwardly drive the retractable key along the bearing component when rotated relative to the bearing component.

In an embodiment, the retractable key is biased in a direction counter to the translation by the cam component. The retractable key may be biased by at least one biasing element. The at least one biasing element may comprise at least one compression spring. The retractable key may be outwardly biased. Alternatively, the clutch adaptor comprises an extension spring or generally any suitable resilient element to outwardly bias the retractable key.

In an embodiment, the clutch adaptor comprises a compression spring having one end engaged with the bearing component and another end engaged with the retractable key to outwardly bias the retractable key.

In an embodiment, one of the cam component and the bearing component is configured to be coupled to a locking actuator operationally coupled to a user operated lock, and the other one of the cam component and the bearing component is configured to be operationally coupled to the latchbolt retractor actuator. The cam component may be configured to be coupled to the locking actuator operationally coupled to the user operated lock, and the bearing component may be configured to be operationally coupled to the latchbolt retractor actuator.

In the context of the present document, "user operated lock" encompasses a coin operated actuator, a push button lock, and a cylinder lock, for example.

In an embodiment, at least one of the pair of rotationally mounted handle couplers comprise a stop configured for arresting the rotation of the bearing component. The adaptor receiver of at least one of the pair of rotationally mounted handle couplers may comprise a stop configured for arresting the rotation of the bearing component. The cam component may be operationally coupled to the locking actuator whereby when the rotation of the bearing component is so arrested, rotation of the locking actuator can camingly disengages the retractable key from the cam component. When the cam component is so disengaged, the outwardly biased retractable key may move outwardly.

In the context of this document, when the retractable key is camingly disengaged from the cam component, the retractable key and the cam component are arranged such that rotation of the cam component does not translate the retractable key.

In an alternative embodiment, at least one of the pair of rotationally mounted handle couplers comprise a stop configured for arresting the rotation of the cam component. The adaptor receiver of at least one of the pair of rotationally mounted handle couplers may comprise a stop configured for arresting the rotation of the cam component. The bearing component may be operationally coupled to the latchbolt retractor actuator, whereby when the rotation of the cam component is so arrested, rotation of the latchbolt retractor actuator camingly disengages the retractable key from the cam component. When the cam component is so camingly disengaged, the outwardly biased retractable key may move outwardly.

In an embodiment, the stop is a removable stop.

In an embodiment, the latchbolt retractor comprises a latchbolt retraction mechanism configured to retract the latch bolt when the latchbolt retractor actuator is rotated. The latchbolt retraction mechanism may be configured to not rotate the latchbolt retractor actuator when the latchbolt is pushed inwards.

In an embodiment, the latchbolt retractor actuator comprises a hollow bar. The locking actuator may comprise another bar received within the hollow bar.

In an embodiment, the clutch adaptor comprises another cam component coupled to the locking actuator and configured to outwardly translate the retractable key along the bearing component when rotated.

In an embodiment, the latchbolt retractor comprises a coupling receiver for receiving any one of a plurality of couplings, at least one of the plurality of couplings being configured to reconfigure the latchbolt retraction mechanism for rotation of the latchbolt retractor actuator when the latchbolt is pushed inward.

In an embodiment, the retractable key has a bearing surface. The retractable key may have another bearing surface. Between the bearing surface and the other bearing surface may be disposed a cam member in the form of a cam plate of the cam component. The cam member may be configured to cooperate with the bearing surface to inwardly translate the retractable key. The cam member may be configured to cooperate with the other bearing surface to outwardly translate the retractable key. Alternatively, between the bearing surface and the other bearing surface may be disposed the other cam component. The other cam component may be configured to cooperate with the other bearing surface to outwardly translate the retractable key. In an embodiment, the cam component comprises a cavity between two lobes followed by the bearing surface of the retractable key. The cavity may be configured to receive the bearing surface of the retractable key for camingly disengagement of retractable key from the cam component and outward extension of the retractable key by the outward bias.

In an embodiment, the other cam component comprises a cam plate. The cam plate may cooperate with the other bearing surface to outwardly translate the retractable key. The cam plate may comprise a lobe having a distal end. The distal end may cooperate with the other bearing surface to outwardly translate the retractable key.

In an embodiment, the other cam component is incorporated in the cam component.

In an embodiment, the plurality of adaptors comprises a transmitting adaptor. The transmitting adaptor may have a single configuration, the single configuration being for engagement with the adaptor receiver of each of the pair of rotationally mounted handle couplers for transmission of the rotation. The transmitting adaptor may comprise a fixed outwardly extended key receivable by the keyway for transmission of the rotation.

In an embodiment, the plurality of adaptors comprises a non-transmitting adaptor. The non-transmitting adaptor may have a single configuration in which the non-transmitting adaptor is not engagable with the adaptor receiver for transmission of the rotation. The non-transmitting adaptor may be a keyless adaptor not engagable with the adaptor receiver of the pair while being received thereby. The keyless adaptor may have a passageway for passage of the locking actuator for coupling to the user operated lock.

In an embodiment, the latchbolt retractor actuator comprises a bar.

In an embodiment, the pair of rotationally mounted handle couplers each comprise a hollow shaft.

Disclosed herein is a lockset comprising a mechanism in accordance with the above disclosure.

Disclosed herein is a kit. The kit comprises a latchbolt retractor that is rotationally actuatable. The kit comprises a rotationally mounted handle coupler. The rotationally mounted handle coupler is rotatable by a rotation of a handle when coupled thereto and comprises an adaptor receiver for receiving any one of a plurality of adaptors. The rotationally mounted handle coupler is configured to engage with at least one of the plurality of adaptors, but not all of the plurality of adaptors, for transmission of the rotation of the handle to a latchbolt retractor actuator.

An embodiment comprises a pair of rotationally mounted handle couplers. Each of the pair is rotatable by a rotation of a handle when coupled thereto and comprise an adaptor receiver for receiving any one of a plurality of adaptors. The pair of rotationally mounted handle couples are each configured to engage with at least one of the plurality of adaptors, but not all of the plurality of adaptors, for transmission of the rotation of the handle to the latchbolt retractor actuator.

In an embodiment, the kit comprises the plurality of adaptors.

Embodiments of the kit may comprise any one or more of the components described above with respect to the mechanism for a lockset.

Disclosed herein is a method for configuring a lockset's function. The method comprises installing a selected adaptor at an adaptor receiver of a rotationally mounted handle coupler of the lockset, the rotationally mounted handle coupler being rotatable by a rotation of a handle when coupled thereto. The selected adaptor is selected from a plurality of adaptors, wherein at least one, but not all of the plurality of adaptors, are for transmission of the rotation of the handle to a latchbolt retractor actuator of the lockset.

Disclosed herein is a method for configuring a lockset's function. The method comprises installing a selected adaptor at an adaptor receiver of a rotationally mounted handle coupler of the lockset and installing another selected adaptor at another adaptor receiver of another rotationally mounted handle coupler of the lockset, the rotationally mounted handle coupler and the other rotationally mounted handle coupler being rotatable by a rotation of a handle when coupled thereto. The selected adaptor and the other selected adaptor are selected from a plurality of adaptors, wherein at least one, but not all of the plurality of adaptors, are for transmission of the rotation of the handle to a latchbolt retractor actuator of the lockset.

An embodiment comprises the steps of installing a clutch adaptor selected from the plurality of adaptors at one of the adaptor receiver and the other adaptor receiver, and operating the clutch adaptor to engage the adaptor receiver while being received thereby for transmission of the rotation and operating the clutch adaptor to disengage the adaptor receiver. Operating the clutch adaptor may comprise operating the clutch adaptor to interlock the clutch adaptor with the adaptor receiver. Operating the clutch adaptor to engage the adaptor receiver may comprise operating the clutch adaptor to outwardly extend a retractable key thereof into a keyway of the adaptor receiver.

An embodiment comprises the step of rotating a bearing component of the clutch adaptor relative to a cam component of the clutch adapter to translate the retractable key along the bearing component of the clutch adaptor. The translation may be inwardly.

An embodiment comprises the step of biasing the retractable key in a direction counter to the translation. The retractable key may be outwardly biased by a compression spring. Alternatively, an extension spring may outwardly bias the retractable key, a leaf spring, a block of resilient material for example a block of rubber, or generally any suitable biasing element.

An embodiment comprises the step of camingly disengaging the cam component from the retractable key for the outward bias to extend the retractable key.

An embodiment comprises the step of arresting the rotation of one of the cam component and the bearing component. In a step, the latchbolt retractor actuator may be rotated to camingly disengage the cam component from a cam follower of the bearing component. In a step, retractable key may be outwardly extended by the outward bias.

An embodiment comprises the step of retracting the latch bolt when the latchbolt retractor actuator is rotated, but not rotate the latchbolt retractor actuator when the latchbolt is pushed inwards.

An embodiment comprises the step of coupling one of the cam component and the bearing component to a locking actuator operationally coupled to a user operated lock, and operationally coupling the other one of the cam component and the bearing component to the latchbolt retractor actuator. In a step, the cam component is coupled to the locking actuator operationally coupled to the user lock, and the bearing component is operationally coupled to the latchbolt retractor actuator.

An embodiment comprises the step of installing a transmitting adaptor selected from the plurality of adaptors at one of the adaptor receiver and the other adaptor receiver. The transmitting adaptor may have a single configuration, the single configuration being for engagement with the adaptor receiver of each of the pair of rotationally mounted handle couplers for transmission of the rotation. The transmitting adaptor may comprise a fixed outwardly extended key receivable by the keyway for transmission of the rotation.

An embodiment comprises the step of installing a non transmitting adaptor selected from the plurality of adaptors at one of the adaptor receiver and the other adaptor receiver. The non-transmitting adaptor may have a single configuration in which the non-transmitting adaptor is not engagable with the adaptor receiver for transmission of the rotation. The non-transmitting adaptor may be a keyless adaptor not engagable with the adaptor receiver of the pair while being received thereby. The keyless adaptor may have a passageway for passage of the locking actuator for coupling to the user operated lock.

Any of the various features of each of the above disclosures, and of the various features of the embodiments described below, can be combined as suitable and desired.

BRIEF DESCRIPTION OF THE FIGURES

Embodiments will now be described by way of example only with reference to the accompanying figures in which:

FIG. 1 shows a table summarising a plurality of lockset functions.

DESCRIPTION OF EMBODIMENTS

Figure 2:
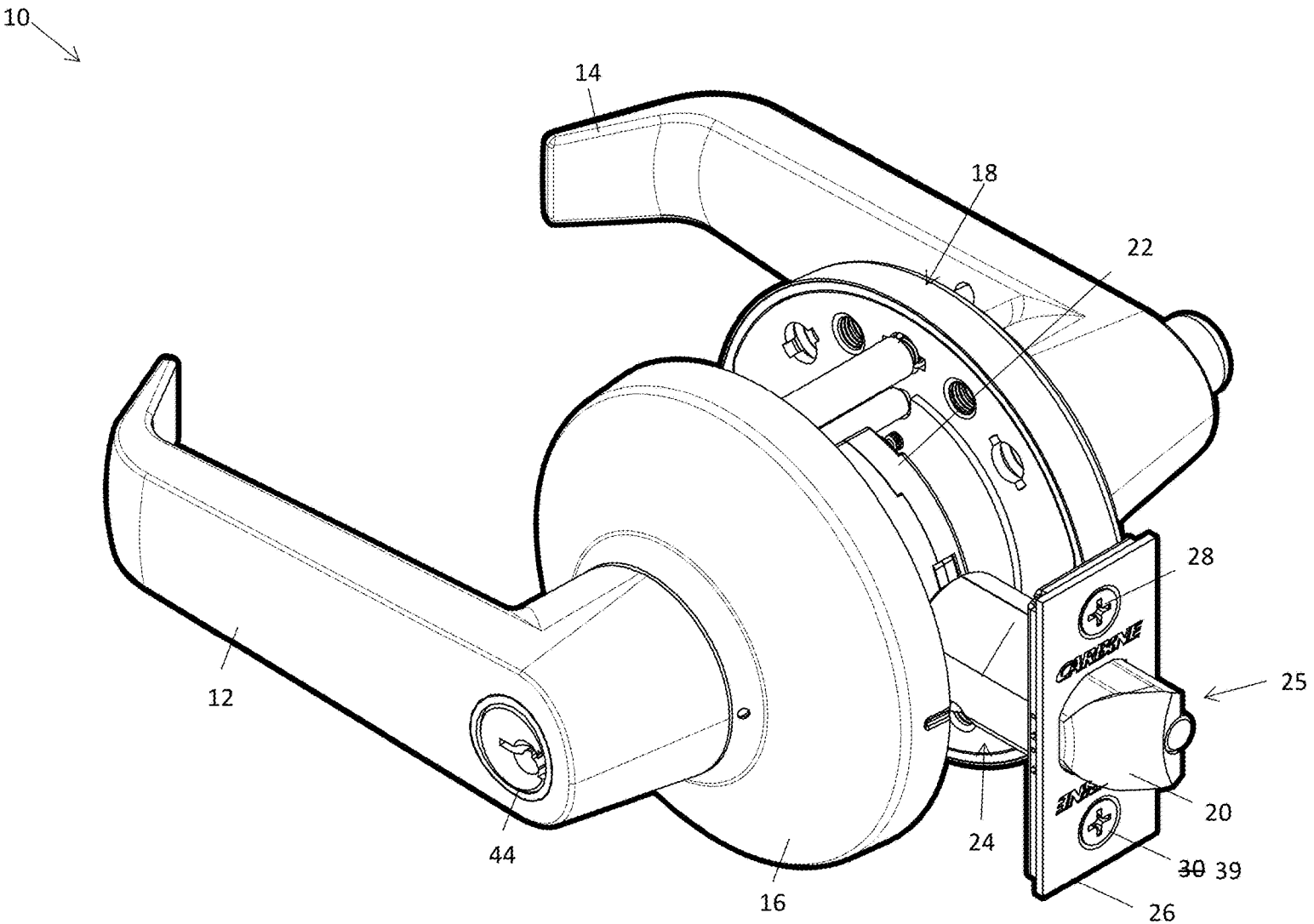
FIG. 2 shows a perspective view of an example of a lockset.

FIG. 2 shows an example of a lockset, the lockset being generally indicated by the numeral 10. This example of a lockset 10 has a first handle 12, a second handle 14, a first rose 16 and a second rose 18, a latch bolt 20, a latchbolt retractor 22 and a latchbolt assembly 24. The latch bolt 20 is outwardly biased from the distal end 25 of the latch assembly 24. The latch assembly 24 comprises a faceplate 26. In use, the latchbolt retractor 22 may be disposed within a cylindrical passageway ("face bore") connecting opposite faces of a hinged barrier in the form of, for example, a door or gate. The cylindrical passageway may have a circular, rectangular or generally any suitably shaped lateral section. Opposite openings of the cylindrical passageway are capped by the first rose 16 and the second rose 18. The cylindrical passageway may generally be adjacent an edge of the hinged barrier. In use the latch assembly 24 is disposed within another passageway ("edge bore") in communication with the cylindrical passageway in which the latchbolt retractor 22 is disposed and having an opening at the edge of the hinged barrier. The latch assembly faceplate 26 is configured for attachment to the edge of the hinged barrier. In this example, the face plate 26 has a plurality of apertures 28, 39 configured for a plurality of fasteners 29 in the form of, for example, screws or nails to pass through and be secured to the hinged barrier.

The first handle 12 and the second handle 14 are each in the form of a lever. It will be appreciated, however, that a handle may take any suitable form, for example a knob. A combination of a lever and a knob, for example, may be used. The first handle 12 and the second handle 14 are detachable. A plurality of alternative handles may be attached, the plurality of alternative handles having different configurations and/or visual appearances. Similarly, the first rose 16 and the second rose 18 are detachable and alternative roses may be attached.

Figure 3:
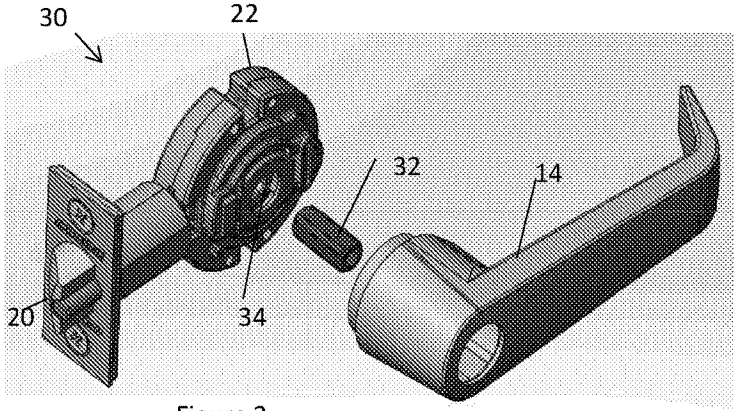
FIG. 3 shows an exploded perspective view of part of an example mechanism for the lockset of FIG. 2 and an example of a handle.

FIG. 3 shows an exploded perspective view of part of a mechanism 30 for the lockset 10. The mechanism comprises the latchbolt retractor 22, which is rotationally actuatable by a latchbolt retractor actuator 32 comprising a hollow bar. The hollow bar 32 has a rectangular, in this example square, lateral section with rounded or chamfered corners. The latchbolt retractor actuator may take any suitable form, for example it may have a hexagonally shaped lateral section. The latchbolt retractor 22 has an actuator coupling 34 (best seen in FIGS. 25 and 34) and configured to rotationally engage by interlocking the retraction mechanism actuator 32. The actuator coupling 34 has a rectangular cavity for receiving the rectangular hollow bar 32.

Figure 4:
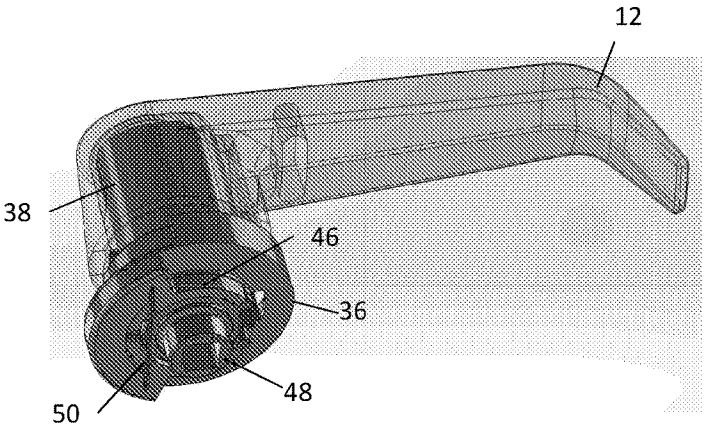
FIG. 4 shows a perspective view of an example handle coupler of the mechanism of FIG. 3 having coupled thereto the handle, wherein the example handle coupler has also received an example clutch adaptor.
Figure 6:
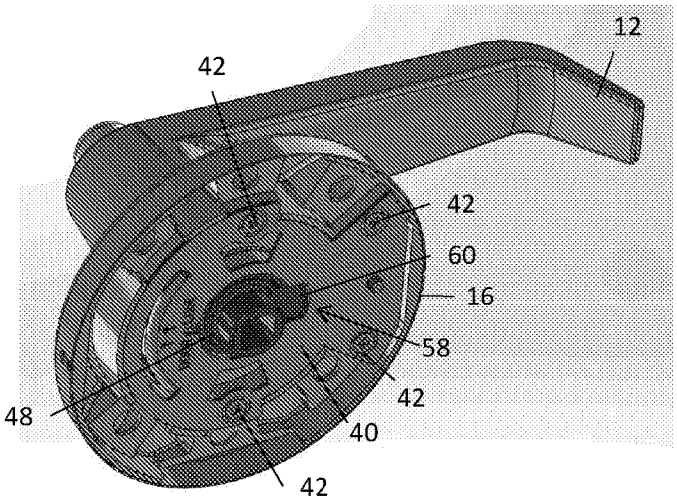
FIG. 6 shows the example handle coupler of FIG. 4 rotationally mounted within an example rose, wherein the example handle coupler has received an example of one of a plurality of example adaptors.
Figure 5:
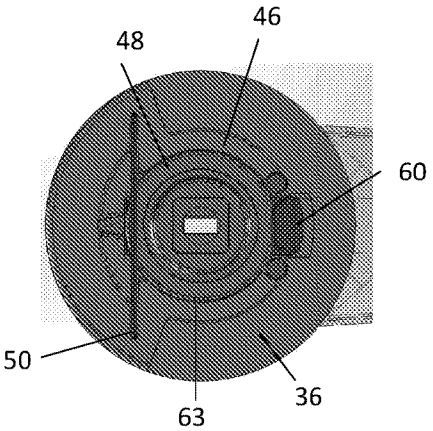
FIG. 5 shows an elevational view of the handle coupler of FIG. 4 and the clutch adaptor of FIG. 4.
Figure 7:
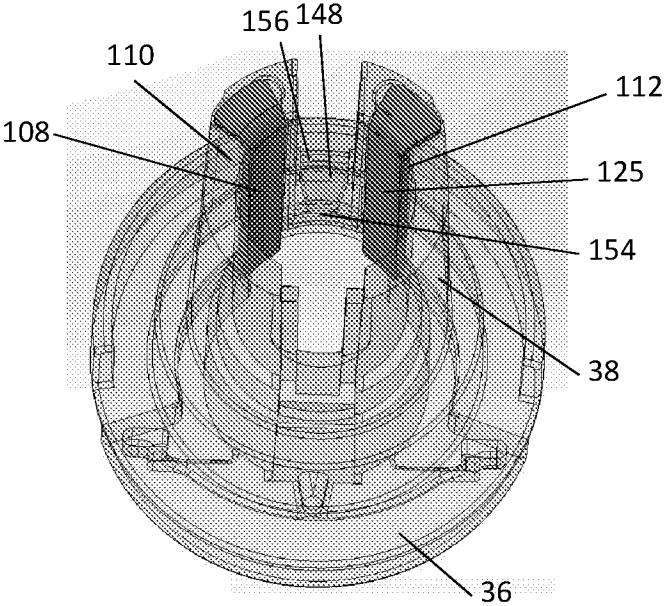
FIG. 7 shows a wireframe drawing of the example handle coupler of FIG. 4.

FIG. 4 shows a perspective view of a handle coupler 36 having coupled thereto the handle 12. The handle coupler 36 is also part of the mechanism 30. FIG. 5 shows an elevational view of the handle coupler 36 of FIG. 3. The handle coupler 36 is rotatable within the rose 16 by a rotation of the handle 12. The handle coupler 36 is rotationally mounted within the rose 16 and held within the rose with a holding plate 40 fastened to the rose 16 with a plurality of fasteners in the form of screws 42, as best understood with reference to FIG. 6. A torsion spring 53 (best seen in FIG. 37) mounted within the rose 16 rotationally biases the handle coupler 36 such that when the handle 12 is depressed downward from a starting orientation the torsion spring returns the handle 12 to the starting orientation. FIG. 7 shows a wireframe drawing of the handle coupler 36. The other handle coupler has, in this but not necessarily all embodiments, identical form and function.

The handle coupler 36 has a shaft in the form of a hollow shaft 38 configured to receive the handle 12. The hollow shaft and the handle 12 are configured to form a meshed joint in the form of a splined joint when the handle is so received. One of the hollow shaft 38 and the handle has a male spline (the handle in this but not all embodiments), and the other of the hollow shaft and the handle has a female spline. Alternatively, the hollow shaft and the handle may be configured to form a keyed joint, for example, or generally any suitable form of joint.

The hollow shaft 38 is configured to receive a user operated lock in the form of, for example, a push-button lock, a cylinder lock 44, a coin operated actuator, or generally any suitable form of user operable lock. In this embodiment, the hollow shaft 38 of the lockset 10 has received therein a cylinder lock 44.

Figure 8:
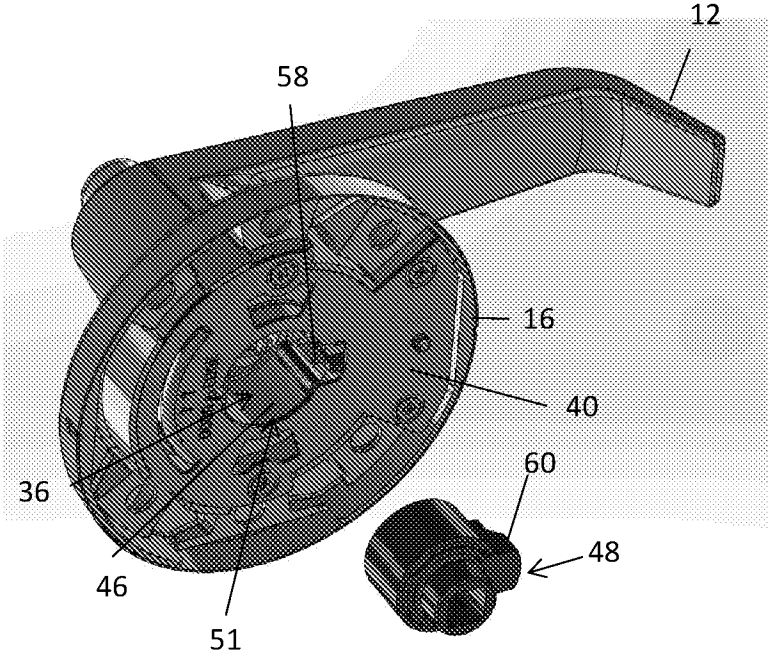
FIG. 8 shows the example handle coupler of FIG. 4 held in the example rose with the example adaptor of FIG. 6 next to the example handle coupler.

The handle coupler 36 has an adaptor receiver 46 for receiving any one of a plurality of adaptors. FIGS. 4 and 5 show an adaptor 48 of the plurality of adaptors received by the handle coupler 36. The handle coupler 36 has a retaining spring 50 that intersects the opening 51 (shown in FIG. 8) of the adaptor receiver 46. The retaining spring 50 may be deflected sideways, with a tool for example, for passage of the adaptor 48 and then released to retain the adaptor 48 within the adaptor receiver 46. FIG. 8 shows the handle coupler 36 held in the rose 16 by the holding plate 40, with the adaptor 48 next to it.

Figure 9:
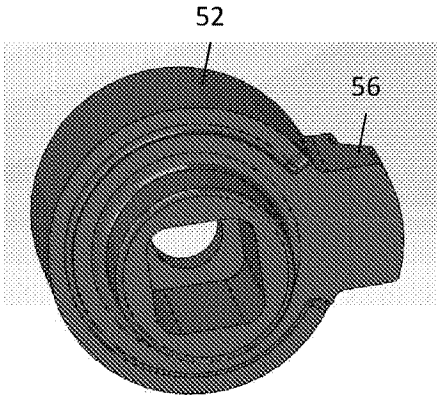
FIG. 9 shows the example adaptor of FIGS. 6 and 8.
Figure 10:
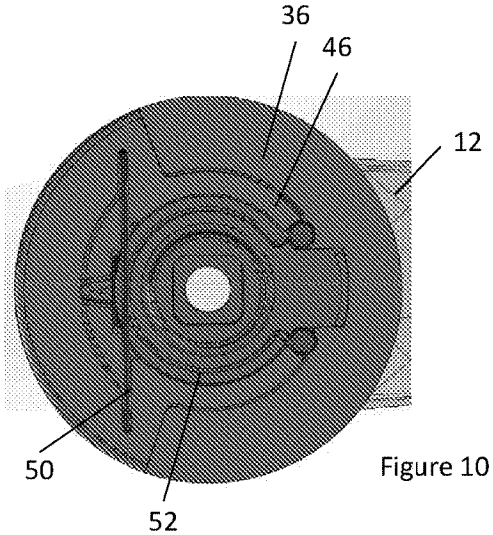
FIG. 10 shows an elevation view of the example handle coupler having received therein the example adaptor of FIGS. 6 and 8.
Figure 11:
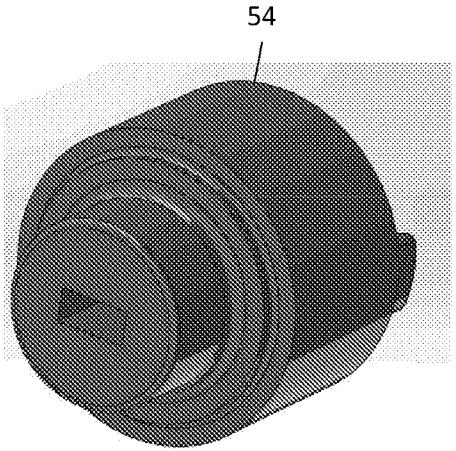
FIG. 11 shows an example of yet another example adaptor of the plurality of example adaptors.
Figure 12:
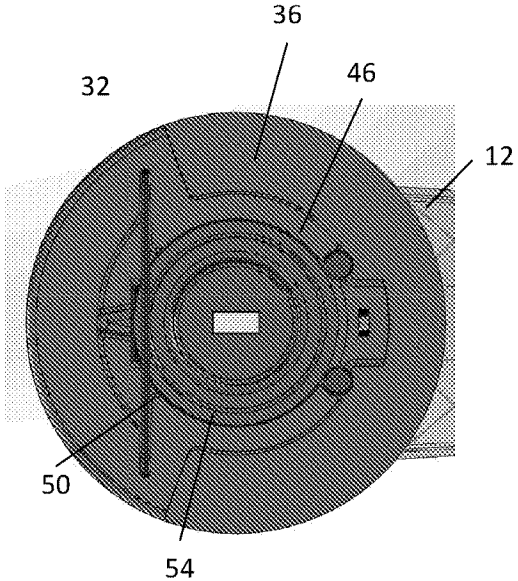
FIG. 12 shows an elevational view of an adaptor receiver of the example handle coupler of FIG. 10 having received therein the adaptor of FIG. 11.

FIG. 9 shows other adaptor 52 of the plurality of adaptors, and FIG. 10 shows an elevation view of the handle coupler 36 having received therein (specifically, received by the adaptor receiver 46) the other adaptor 52. FIG. 10 shows an example of yet another adaptor 54 of the plurality of adaptors, and FIG. 12 shows an elevational view of the handle coupler 36 having received therein the yet other adaptor 54.

The adaptor receiver 46 is configured to engage with at least one of the plurality adaptors 48, 52 and 54 for transmission of the rotation of the handle 12 to the latchbolt retractor actuator 32. In the present embodiment, the adaptor receiver 46 interlocks with the at least one of the plurality of adaptors 48, 52, but not another of the plurality of adaptors 54. For example, the adaptor receiver 46 is configured to engage adaptor 52 while being received by the adaptor receiver 46, the adaptor 52 being a transmitting adaptor for transmitting the rotation. The transmitting adaptor 52 is configured for interlocking engagement with the adaptor receiver 46. The transmitting adaptor 52 has a fixed outwardly extended key 56. The adaptor receiver 46 is in the form of a socket comprising a key way 58. The fixed outwardly extended key 56 is receivable by the key way 58 for transmission of the rotation of the handle coupler to the latchbolt retractor actuator 32. The transmitting adaptor 52 has, in this embodiment, a single configuration. The adaptor 52 couples the retractor actuator 32 to the handle coupler 36.

Not all of the plurality of adaptors, however, are for transmission of the rotation of the handle to the latchbolt retractor actuator 32. Adaptor 54 is a non-transmitting adaptor in the form of a keyless adaptor not engageable with the adaptor receiver 46 while being received thereby. Adaptor 54 is not configured for transmission of the rotation.

It will be appreciated that the handle 12 may be operated to actuate the latchbolt retractor mechanism 22 when the transmitting adaptor 52 is received by the adaptor receiver 46, but the handle 12 will not actuate the latchbolt retractor 22 when the adaptor receiver 46 has received the non-transmitting adaptor 54.

The rose 18 is configured similarly or identically to rose 16. Consequently, an adaptor receiver of rose 18 may receive any one of the plurality of adaptors 48, 52, 54, and similarly be coupled and decoupled from the latchbolt retractor 22. Consequently, the configuration of the mechanism 30 may be changed, and so its function, by selecting which of the plurality of adaptors is received by the adaptor receiver 46 and the other adaptor receiver of the rose 18.

Figure 14:
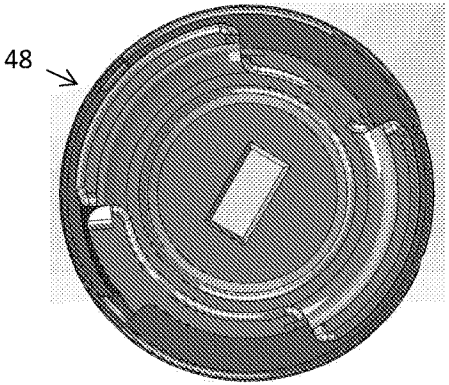
FIG. 14 shows the example clutch adaptor of FIG. 13 in another mode in the same elevational view.
Figure 13:
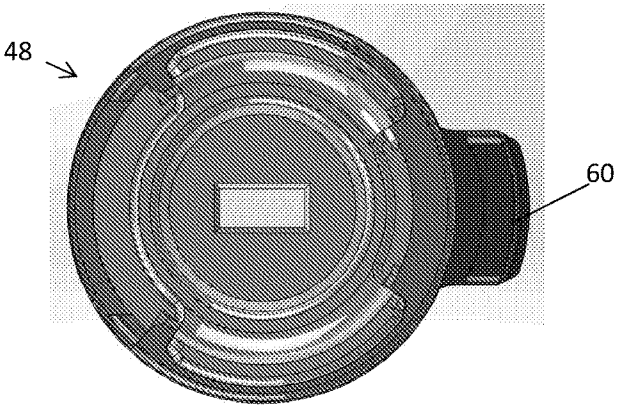
FIG. 13 shows an elevation view of an example clutch adaptor in one mode.

The plurality of adaptors 48, 52, 54 comprises a clutch adaptor 48. FIG. 13 shows an elevation view the clutch adaptor 48 in one mode, and FIG. 14 shows the clutch adaptor of FIG. 13 in another mode in the same elevational view. The clutch adaptor 48 is operable to engage the adaptor receiver 46 while being received thereby for transmission of the rotation. The clutch adaptor 48 is also operable to disengage the adaptor receiver 46 while received thereby so that handle rotation is not transmitted. The clutch adaptor 48 in the one mode (FIG. 13) can interlock with the adaptor receiver 46. The clutch adaptor 48 has a retractable key 60 and is operable to outwardly extend the retractable key 60 and also operable to retract the retractable key. In the one mode, the retractable key 60 is extended to be received by the key way 58 so interlocking the clutch adaptor 48 to the adaptor receiver 46. In the other mode (FIG. 14), the retractable key 60 is retracted and so the clutch adaptor 48 is no longer interlocked with the adaptor receiver 46. In the other mode, the clutch adaptor 48 is freely rotatable within an inner bearing surface 63 of the adaptor receiver 46, without transmission of rotation between the clutch adaptor 48 and the adaptor receiver 46.

Figure 15:
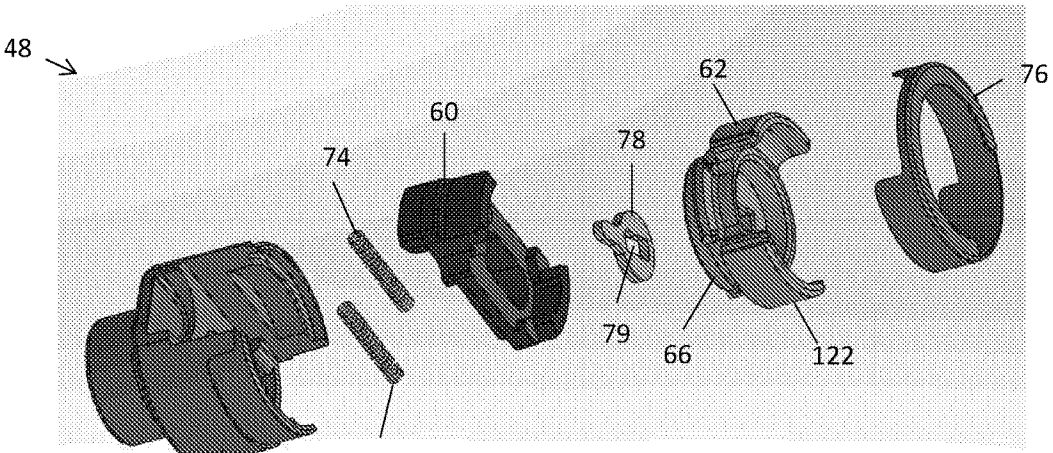
FIG. 15 shows an exploded view of the clutch adaptor of FIGS. 13 and 14.
Figure 16:
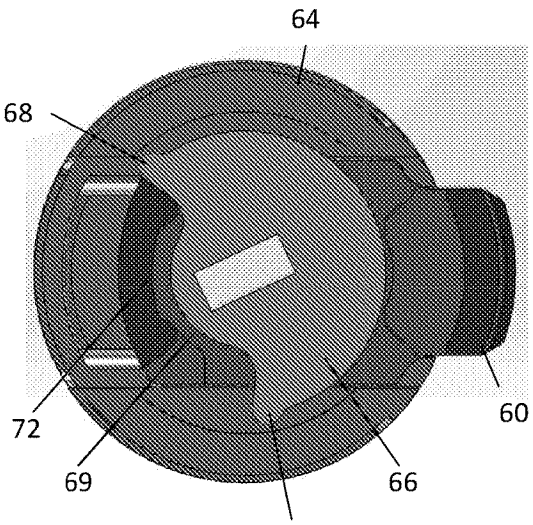
FIGS. 16 and 17 show a plan view of an example retractable key received by an example bearing component and engaged with an example cam plate of an example cam component.
Figure 17:
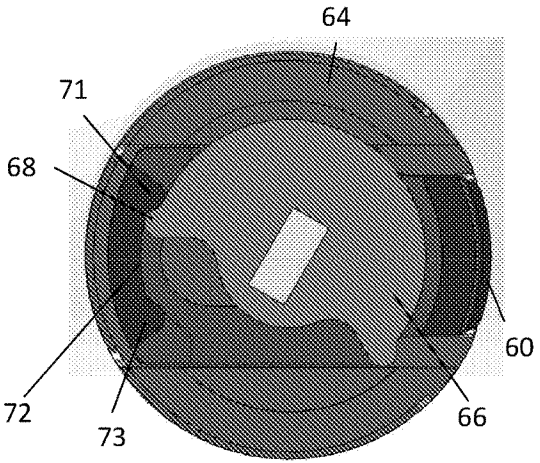
Figure 18:
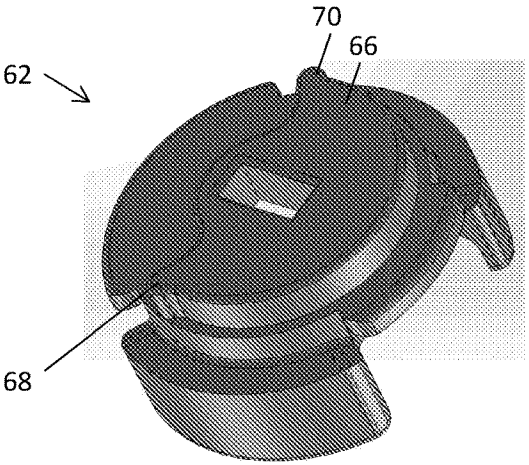
FIGS. 18 and 19 show underside and top perspective views of the example cam component of FIGS. 16 and 17.
Figure 19:
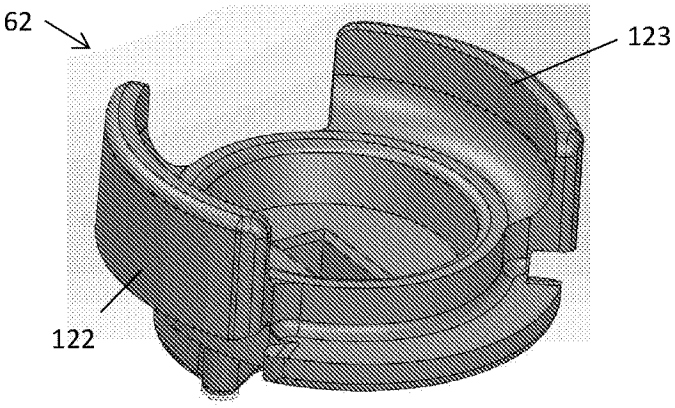
Figure 21:
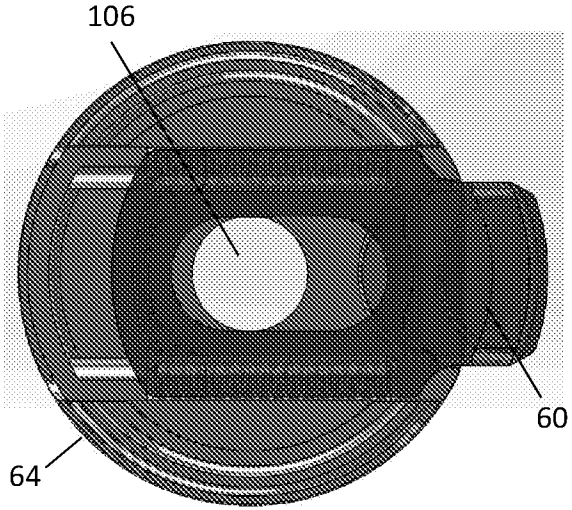
FIG. 21 shows a top view of the example bearing component of FIGS. 16 and 17 with the example retractable key received thereby.

FIG. 15 shows an exploded view of the clutch adaptor 48. The clutch adaptor comprises a bearing component 64 on which the retractable key 60 is mounted. FIG. 21 shows a top view of the bearing component 64 with the retractable key 60 received thereby. The clutch adaptor 48 also has a cam component 62 configured to translate the retractable key 60 along the bearing component 64 when rotated relative to the bearing component 64, such that the retractable key 60 is driven inwardly along the bearing component. FIGS. 18 and 19 show respective underside and top perspective views of the cam component 62. FIGS. 16 and 17 show a plan view of the retractable key 60 received by the bearing component 64 and engaged with a cam comprising a cam plate 66 of the cam component 62. In this but not all embodiments, the cam plate is integral with the cam component. When the cam component 62 is rotated relative to the bearing component 64, a cam plate lobe 68 or 70 of the cam plate 66 is followed by a bearing surface 72 in the form of a concave bearing surface of the retractable key 60. The cam plate lobe 68 or 70 pushes the following bearing surface 72 when rotated to retract the retractable key 60.

The bearing surface 72 is delimited by a first bearing surface lobe 71 and a second bearing surface lobe 73. The cam plate lobe 68 (or 70) in contact with the bearing surface 72 is confined, that is trapped, by the first lobe 71 and the second lobe 73, which maintains the retractable key in the retracted position. In this but not necessarily all embodiments, for lobe 68 to ride over either lobe 71 or 73, the retractable key 60 is first moved inwards. A user induced rotation of the cam component 62 and the cam plate 66 relative to the bearing component may, however, cause inward movement of the key 60 and movement of the bearing surface 72 (including the lobes 71 and 73) while the lobe 68 (or 70) rides over the lobe 71 (or 73). This arrangement may be reversed, where 71 and 73 is on the cam plate, which may trap another lobe on the retractable key.

Once the lobe 68 is outside the bearing surface delimited by the first and second lobes 71 and 73, for example when lobe 68 is in contact with the outside slope of lobe 71, or lobe 70 is in contact with the outside slope of lobe 73, the biasing element 74 may then outwardly extend the key 60.

In an alternative embodiment, the lobes 68, 70 may take the form of fingers, and/or the cam plate may have considerable thickness. Generally, the cam component 62 may take any suitable form.

As shown in FIG. 15, the clutch adaptor 48 comprises at least one biasing element in the form of at least one compression spring 74, in this embodiment two parallel compression springs disposed adjacent opposite sides of the retractable keys 60, although more than two compression springs may be used. One end of the compression springs engage the bearing component 64 and another end of the compression springs 74 engage with the retractable key 60 to outwardly bias the retractable key 60. Alternative embodiments may have an extension spring to outwardly bias the retractable key 60, a leaf spring, a block of resilient material for example a block of rubber, or generally any suitable biasing element. This arrangement may be reversed, wherein the retractable key is biased inward and the cam component is configured to drive the retractable key 60 outwardly.

Figure 23:
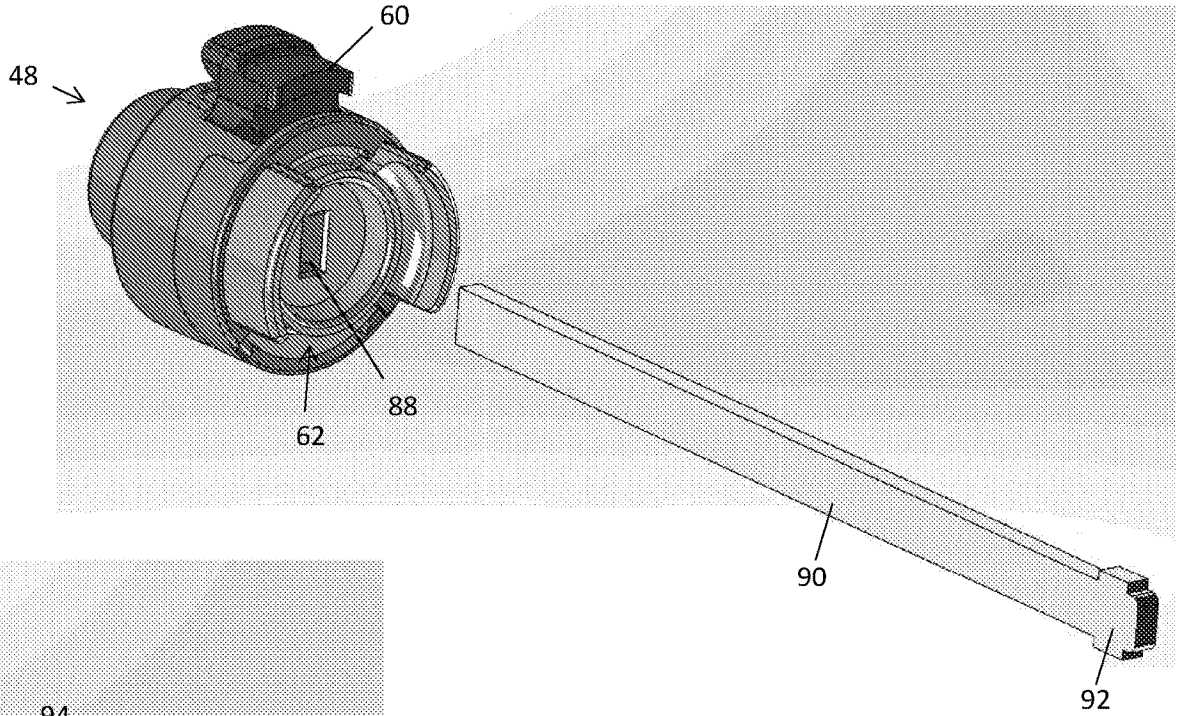
FIG. 23 shows a perspective view of another end of the example clutch adaptor of FIGS. 13 and 14 having the example cam component.

Not shown in FIG. 15 is a locking actuator 90 that passes through the clutch adaptor 48 and each of components 60, 62, 64, 72, 78. The locking actuator 90 is shown in FIG. 23. The locking actuator 90 is operationally coupled to the user operated lock 44.

Figure 20:
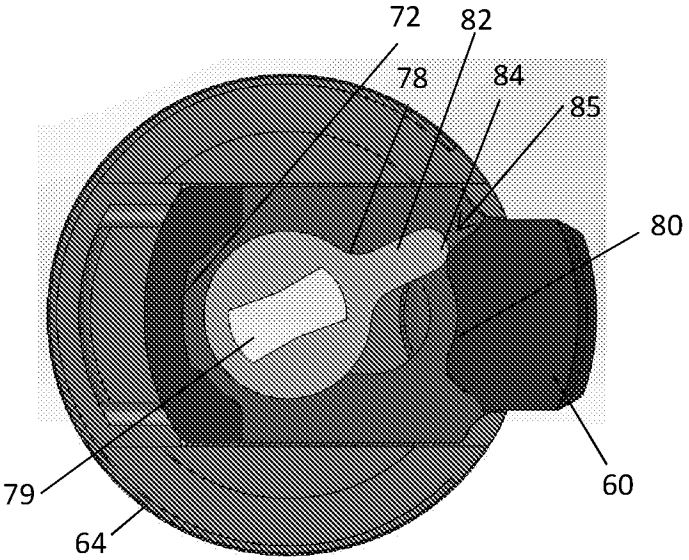
FIG. 20 shows the example retractable key of FIGS. 16 and 17 engaged by another example cam.

The cam plate 66 has a cavity 69 located between the cam plate lobes 68,70. The retractable key 60 may be disengaged from the cam component 62 by disposing the bearing surface 72 between the cam plate lobes 68,70. The bearing surface 72 is free to move into the cavity 69 when the bearing surface is so disposed. When the retractable key 60 is so disengaged from the cam component 62, the at least one biasing element 74 extends the retractable key. The key 60 may not be translated outwardly until the retractable key 60 is aligned with (i.e. at) the keyway 58. There is a risk that contamination of the lockset with dirt or dust, for example, may prevent the at least one biasing element 74 translating the retractable key 60 outwardly. In the case of fire or other emergency, for example, it may be desirable to have an additional or alternative mechanism for extending the retractable key. As shown in FIG. 20, the retractable key 60 may have another bearing surface 80. Between the bearing surface 72 and the other bearing surface 80 may be disposed another cam component 78 shown in FIGS. 15 and 20. The other cam component 78 may be in the form of a cam plate. The cam plate 78 comprises a lobe in the form of a finger 82 having a distal end 84 at which is an engagement surface 85 that cooperates with the other bearing surface 80 to outwardly extend the retractable key 60 when the cam component 78 is rotated relative to the retractable key 60. The other cam component 78 is mounted on the locking actuator 90. The locking actuator 90 may pass through slot 79, coupling the locking actuator 90 to the other cam component 78. Operation of the user operated lock 44 rotates the locking actuator 90 which may in turn rotate the other cam component 78. Consequently, if the at least one biasing element is insufficient the other cam component 78 may extend the retractable key 60 when the user operated lock 44 is operated to engage the clutch adaptor 48 with the handle couplers 36. The other cam component 78 may have a butterfly slot 79 (best seen in FIG. 20), which provides a degree of lost motion of the locking actuator 90 therein.

Figure 33:
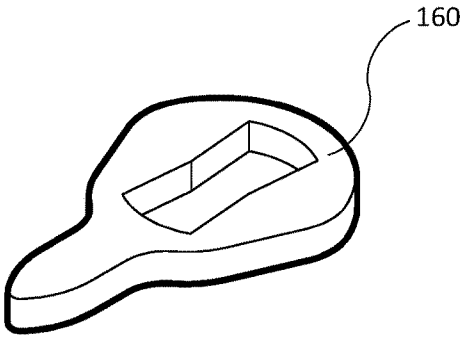
FIG. 33 shows an example of another example cam that may be part of the lockset of FIG. 2.

In this embodiment, the distal end 84 is round, however it may be pointed as in an alternative embodiment of the other cam 161 shown in FIG. 33. In another embodiment, the other cam component 78 may be a plate. In an alternative embodiment, the other cam component 78 is incorporated in the cam component 62. Generally, the other cam component 78 may take any suitable form.

The clutch adaptor 48 has a cap 76 configured to be fixed to the bearing component 64 to form a housing in which to contain the compression springs 74, the retractable key 60, the bearing component 62, and optionally the other cam component 78.

FIG. 23 shows a perspective view of one end of the clutch adaptor 48 having the cam component 62. The cam component 62 defines a central slot 88 for receiving a locking actuator 90 in the form of a flat bar. In FIG. 23, the locking actuator 90 is shown removed from the adaptor 48. The flat bar 90 interlocks with the cam component 62 such that rotation is transmitted between the cam component 62 and the flat bar 90. The locking actuator in the form of the flat bar 90 is coupled to the user operated lock within handle 12. A distal end 92 of the locking actuator 90 is received within a butterfly slot defined by the user operated lock. Rotation is transmitted between the walls defining the butterfly slot of the user actuated lock and the locking actuator 90, between the locking actuator 90 and the cam component 62, and optionally between the locking actuator 90 and the other cam component 78. The optional other cam components 78 has a slot in the form of a butterfly slot that provides a degree of lost rotation, which assists in an anti-lockout function, which is described below. In the present embodiment, the locking actuator 90 is also coupled to another user operated lock associated with handle 14 of the lockset 10, on the other side of the latchbolt retractor 22. The other user operated lock is in the form of a cylinder lock, however it may take any suitable form including but not limited to a push-button lock or coin operated actuator.

The butterfly slot on the user operated lock 44 assists in a clutching handle function. When the lock 44 is in a locked state and the clutching adaptor is decoupled from the handle, clutching the handle (turning it approximately by 45, 55, or 75 degrees, for example) turns the locking actuator 90 along with the user operated lock, if it was not for the butterfly slot.

Figure 22:
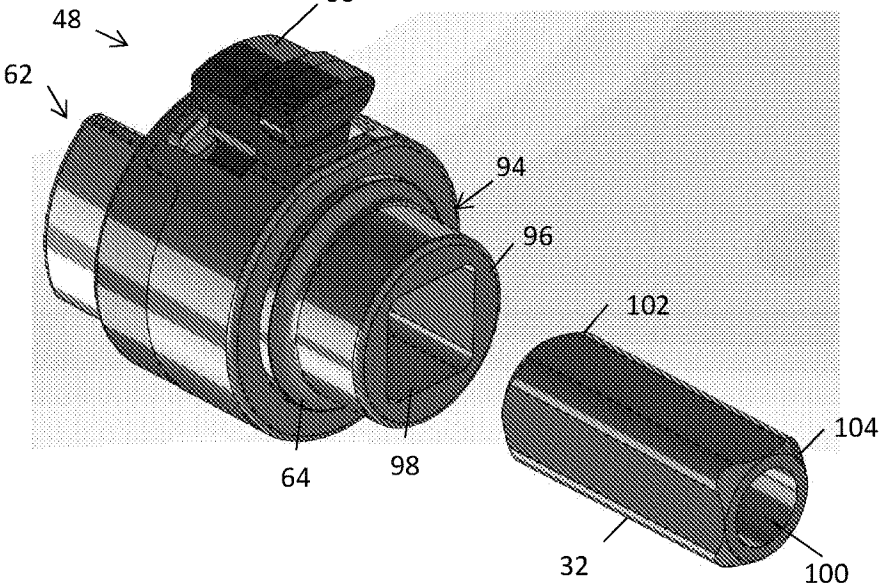
FIG. 22 shows a perspective view of an end of the example clutch adaptor of FIGS. 13 and 14 having the example bearing component thereof next to an example latchbolt retractor actuator.

FIG. 22 shows a perspective view of another end of the clutch adaptor 48 having the bearing component 64. The bearing component 64 is configured to be operationally coupled to the latchbolt retractor actuator 32. A distal end 94 of the bearing component 64 has a latchbolt retractor actuator coupler 96 comprising a socket 98 for interlocking engagement with the latchbolt retractor actuator 32. In this embodiment the socket 98 and actuator 32 are square, however they may have any suitable geometry, for example hexagonal.

The socket 98 has a square lateral section for receiving the square bar 32, and an aperture 106 formed in in the bottom of the socket 98—as seen in FIG. 21—for passage of the locking actuator 90 therethrough. The square bar 32 has a longitudinal passageway 100 opening at opposite ends 102 and 104 of the latchbolt retractor actuator 32. In use, the locking actuator 90 is received within the longitudinal passageway 100.

Figure 24:
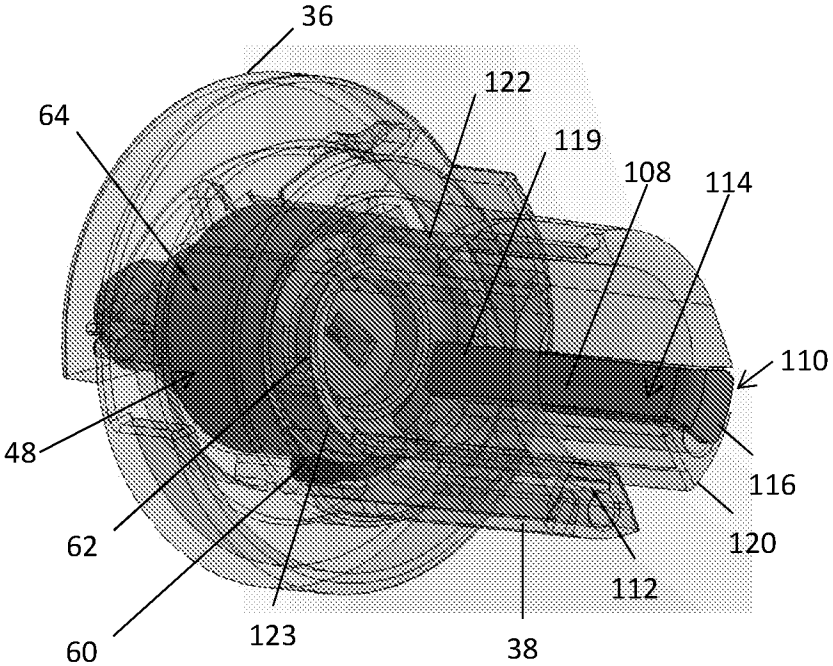
FIG. 24 shows another wire frame drawing of the example handle coupler.

FIG. 24 shows a wire frame drawing of the handle coupler 36, with the clutch adaptor 48 received by the adaptor receiver 46 of the handle coupler 36. The key 60 is extended and so the lock is in an unlocked state. The handle coupler 36 has a stop 108 configured for arresting a rotation of one of the cam component 62 and the bearing component 64, and which is in this embodiment removable. In the example shown in FIG. 24, the stop 108 is for arresting rotation of the cam component 62, but in an alternative embodiment it maybe for arresting rotation of the bearing component 64.

The shaft 38 of the handle coupler 36 comprises a slot in the form of an inwardly flaring slot 110 for securely receiving the stop 108. The stop 108 comprises an elongated tab 114 and a distal end at which is attached an insertion stop 116 for locating a proximal end 119 of the stop 108 at a predetermined position at the adaptor receiver 46. The cam component 62 has a stop receiver comprising two tabs in the form of longitudinal tabs 122,123 for interference by the stop 108 for arresting rotation. The insertion stop comprises a flange 116 that when the stop 108 is received abuts an end 120 of the shaft 38 and which may function as a handle to facilitate insertion and removal of the stop 108 by a user. In the present embodiment, but not necessarily in all embodiments, the shaft 38 has a plurality of slots 110, 112 for securely receiving the stop 108. The stop 108 may be inserted in any of the plurality of slots 110, 112 as suitable, depending on which side of the hinged barrier the handle coupler 36 is disposed. FIG. 7 shows the plurality of slots 110, 112 having securely received therein stops 108, 125.

When one of the cam component 62 and the bearing component 64 (in this embodiment the cam component 62, but in another embodiment the bearing component 64) has its rotation arrested by the stop 108, rotation of the other by the latch bolt retraction actuator (in this embodiment the bearing component 64) results in the translation of the retractable key 60 along the bearing component 64. In this embodiment, the translation is an extension of the retractable key 60 along the bearing component 64.

The stop 108 arrests tab 122, generally trapping the tab 122 at a side of the handle coupler 36. Stop 108, for example, may not be used for the double glass and classroom door function. For these functions, coupling 146 may be used.

When the clutch adaptor 48 is in the locked state and the key 60 is retracted, tab 123 is in contact with stop 108.

An example of a sequence of steps of operation is:

Stop 108 contacts tab 122 when the key is extended;

the cam component 62 is rotated in a direction where tab 122 rotates away from the stop 108 while tab 123 rotates towards the stop 108;

tab 123 contacts the stop 108 and continued rotation of the cam component 62 causes relative motion between cam component 62 and bearing component 64 the key 60 is retracted.

Optionally, if the lockset is configured to prevent a lockout, or during rotation of the inside handle, for example, the bearing component 64 is rotated in the same direction as the inside handle. Tab 123, however, is already in contact with the stop 108 and so rotation of the tab 123 and cam component 66 is arrested, resulting in a relative rotation of the cam component 62 relative to the bearing component 64. Consequently, with the stop 108 received, when the other handle 14 is rotated the retractable key 60 is received by the keyway 58 engaging the clutch adaptor 48 with the handle coupler 36, enabling a user to retract the latch bolt 20 by rotating handle 12. This function can be disabled by removal of the removable stop 108 from the slot 110.

Figure 25:
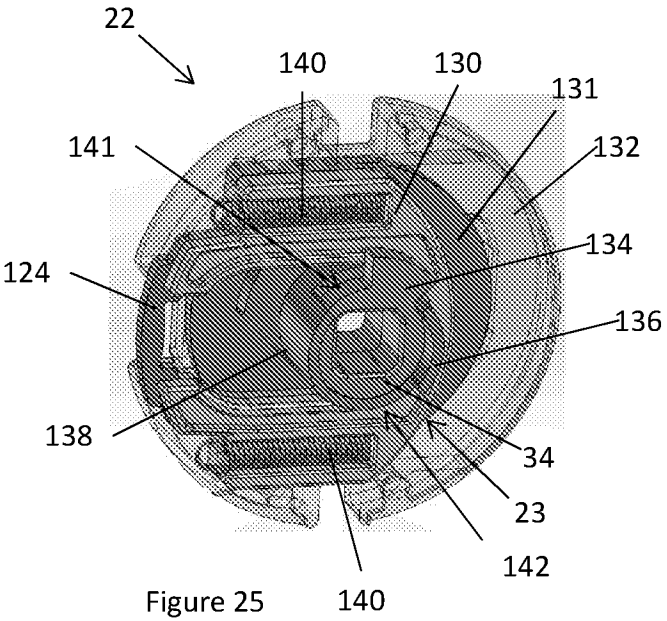
FIG. 25 shows a cutaway view of an example latchbolt retractor.
Figure 30:
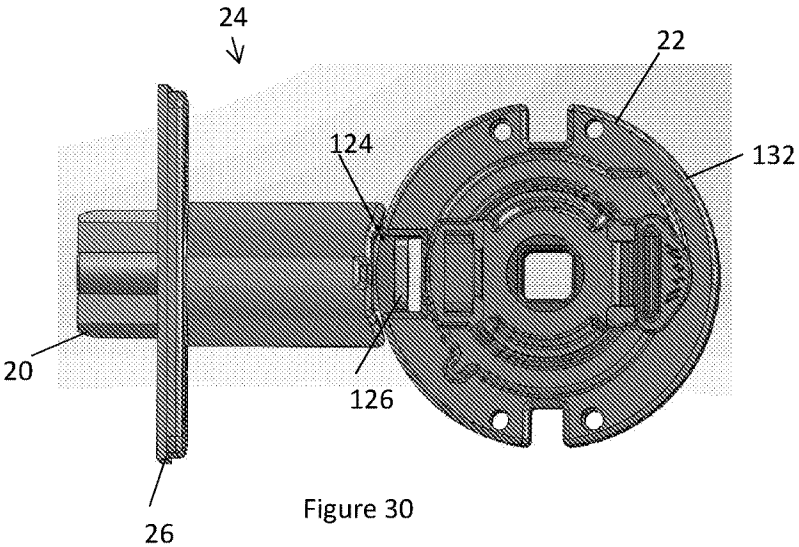
FIG. 30 shows the example latchbolt retractor of FIG. 25 coupled to an example latch assembly.
Figure 36:
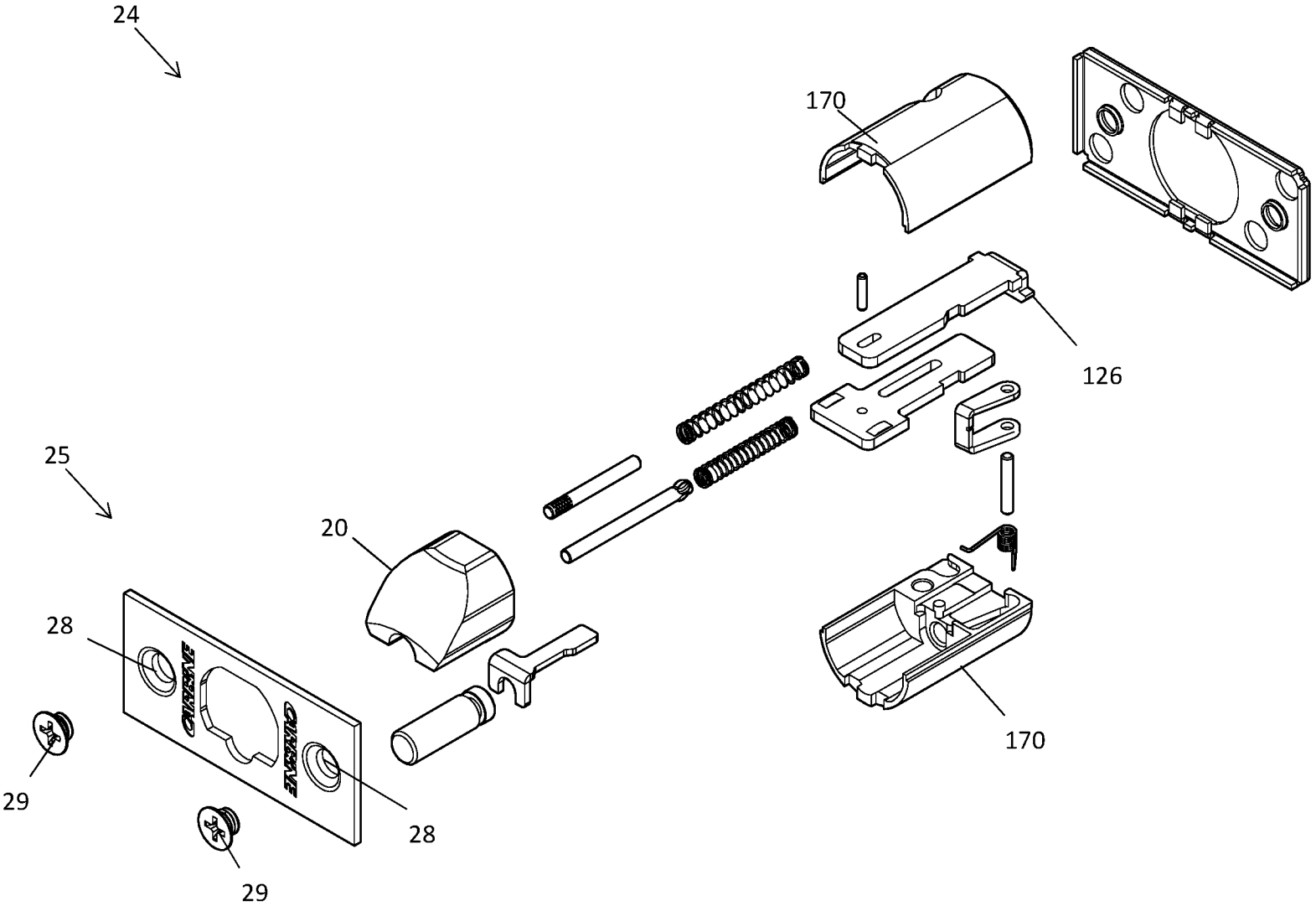
FIG. 36 shows an exploded view of an example latch bolt assembly of the lockset of FIG. 2.

FIG. 25 shows a cutaway view of the latchbolt retractor 22. The latchbolt retractor 22 has a latch bolt assembly coupler 124 in the form of a slotted plate. As shown in FIG. 30, the latch bolt assembly 24 has a hook 126 at a proximal end thereof that in use is received by the slotted plate 124. FIG. 36 shows an exploded perspective view of the latch bolt assembly 24, comprising a latchbolt assembly housing 170. The latchbolt retractor 22 comprises a latchbolt retraction mechanism 23 configured to retract the latch bolt 20 when the latchbolt retractor actuator 32 is rotated, but not rotate the latchbolt retractor actuator 32 when the latch bolt 20 is pushed inwards. The latchbolt retraction mechanism 23 comprises a carriage 130 slidably mounted in the latch bolt mechanism housing 132 and to which the latchbolt assembly coupler 124 is attached. The slidably mounted carriage 130 is outwardly biased by at least one biasing element in the form of an extension spring 140. Alternatively, the biasing element may be a compression spring or generally any suitable form of biasing element, for example a leaf spring or an extension spring. The slidably mounted carriage 130 is operationally coupled via a rack-and-pinion arrangement to plate 131 having the pinion 133 and housed in the latch bolt mechanism housing 132 and mounted to rotate around an axis of rotation. The carriage 130, which has the rack, is translated within the housing 132 by rotation of the plate 131 within the housing 132. The actuator coupling 34 is mounted to rotate around the axis of rotation, and has a flange 134 located in an over-sized space 141 between two flange engagers 136, 138 operationally coupled to the pinion 133 provide a degree of lost motion. Clockwise rotation of the actuator coupler 34 by rotation transmitted by the latchbolt retractor actuator 32 engages flange engager 136 and further rotation is transmitted to the flange engager 136 operating the plate 131 which is followed by the carriage 130, and the latchbolt assembly coupler 124 with it. The rotationally biased handle coupler 36 turns the actuator coupler 34 via the latchbolt retractor actuator 32 when the handle is released, returning the flange 134 to the default position shown in FIG. 24. Pushing the latch bolt 20 inwards, however, does not rotate the latch bolt retracting mechanism in view of the degree of lost motion provided by the oversized space 141.

Figure 34:
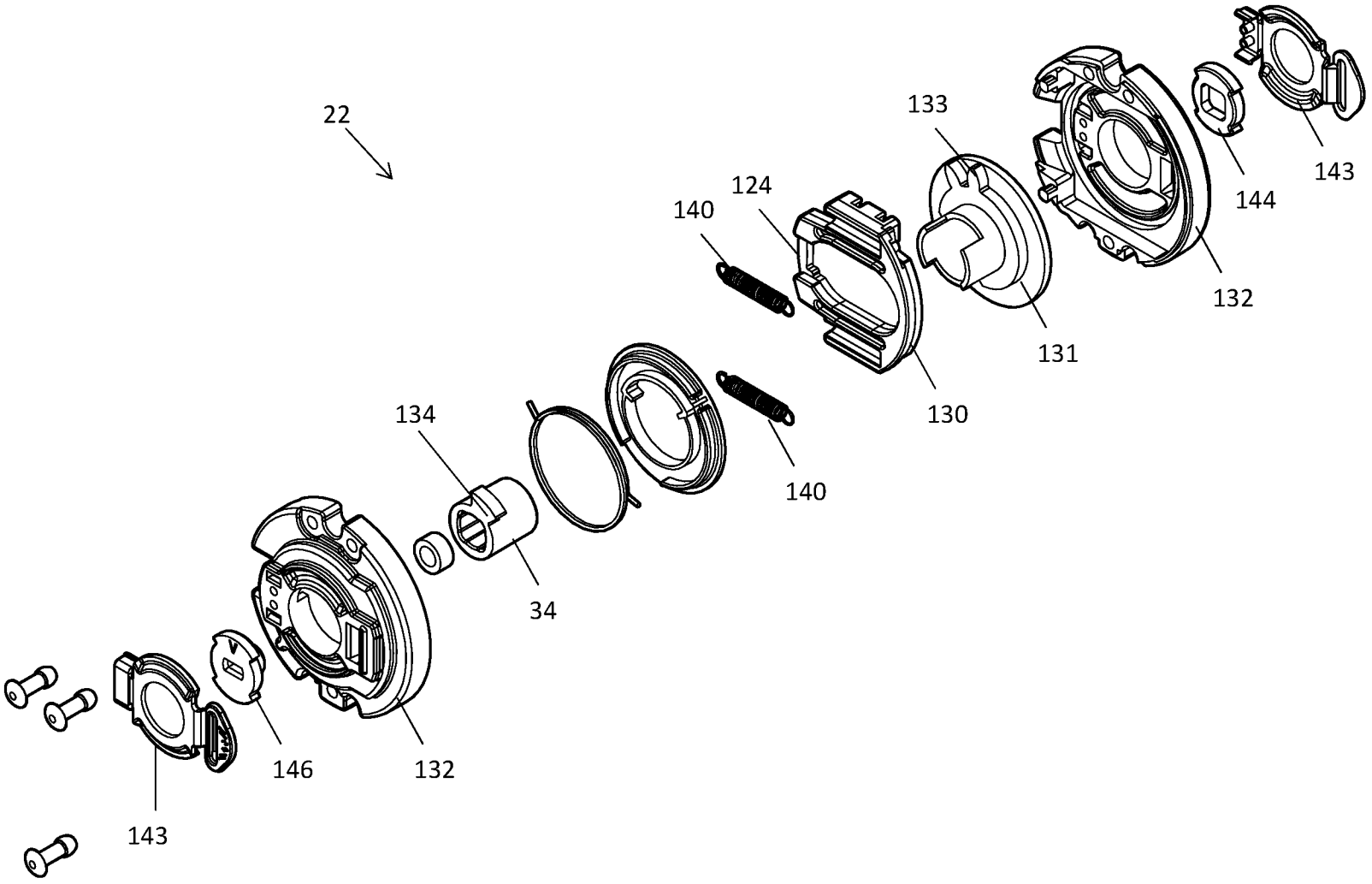
FIGS. 34 and 35 show exploded views of the example latchbolt retractor of the lockset of FIG. 2.
Figure 35:
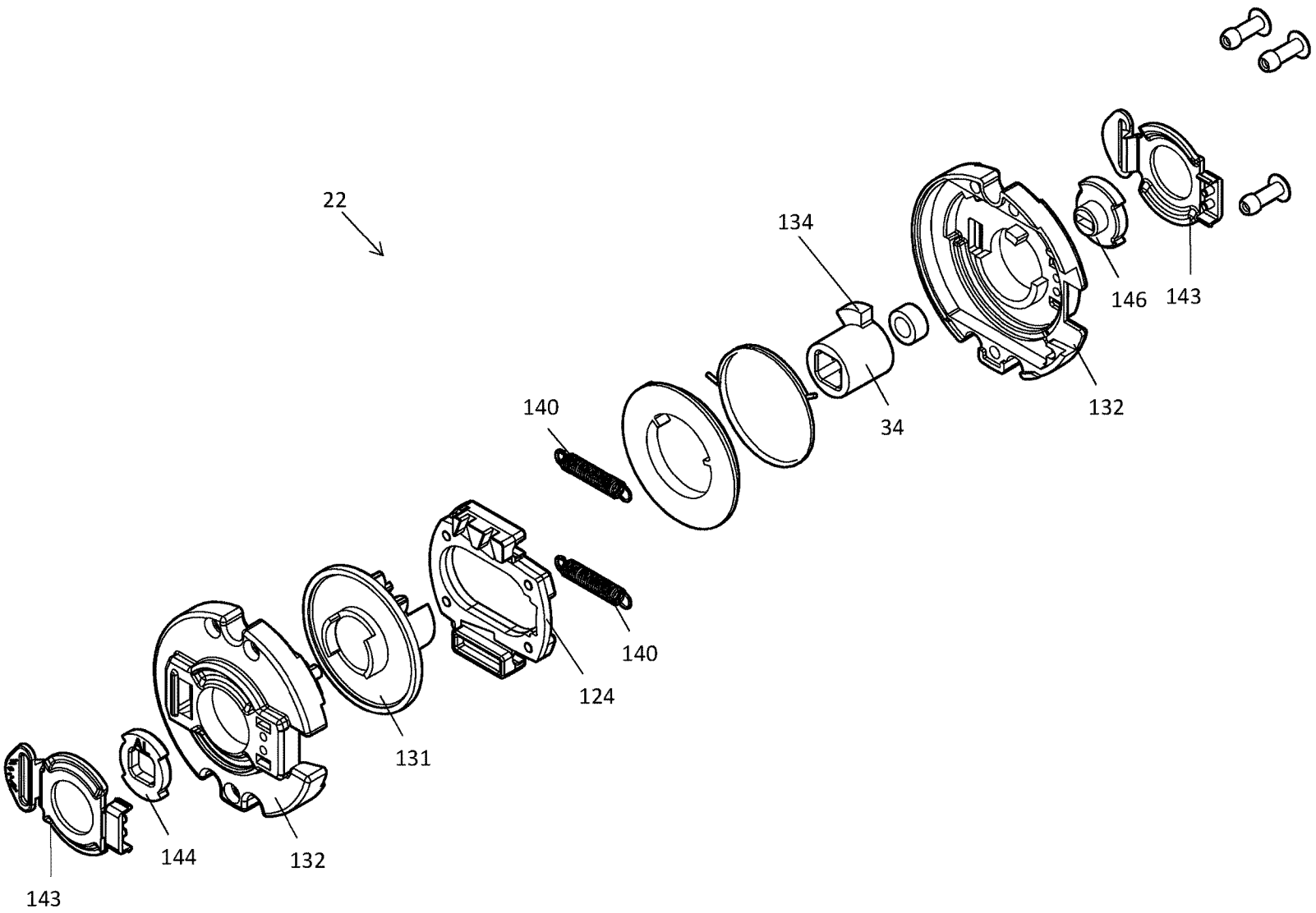

Consequently, when the clutch adaptor 48 is received, there is the possibility of lockout because the latchbolt retractor actuator 22 is not rotated when the latch bolt 20 is pushed inwards, for example when it is pushed inwards by a strike plate attached to a doorjamb for the hinged barrier. The lockset 10 is provided, however, with an anti-lockout option for preventing a lockout. The latchbolt retractor 22 comprises a coupling receiver 142 comprising the two flange engages 136, 138. The coupling receiver 142 is configured for receiving the coupling 144, as shown in FIGS. 26 to 29. The coupling 144 when received by the coupling receiver, as shown in FIG. 25, reconfigures the latchbolt retraction mechanism 23 for rotation of the latchbolt retractor 22 when the latch bolt is pushed inwards. FIGS. 34 and 35 show exploded views of the latchbolt retractor 22. The coupling 144 couples the latchbolt retractor actuator 32 to the flange engagers 136, 138 and the plate 131. Generally, any suitable part may be used to couple the latchbolt retractor actuator 32 to the flange engagers 136, 138, for example an arcuate insert disposed between the flange engager 138 and the flange 134.

Figure 27:
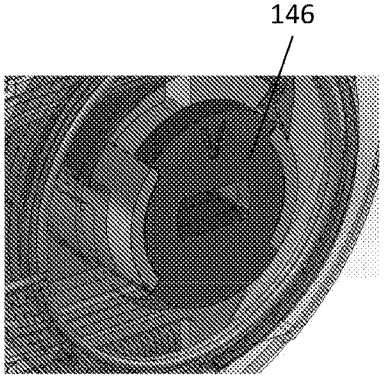
FIG. 27 shows another example coupling received by the example coupling receiver of FIG. 26.

The coupling receiver 142 is also configured for receiving coupling 146 shown in FIG. 27. Coupling 146 couples the locking actuator 90 to the cam plate 131 so that the latchbolt retractor 22 is actuated by the user operable lock 44.

Figure 29:
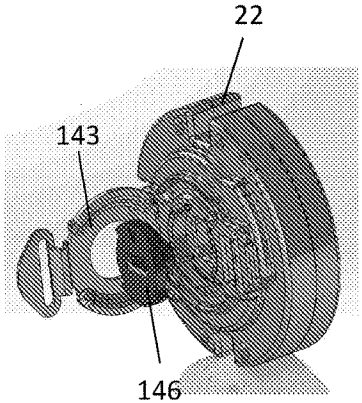
FIGS. 28 and 29 shows a coupling cage of the latchbolt retractor in an open state for receiving the example coupling and the other example coupling.
Figure 26:
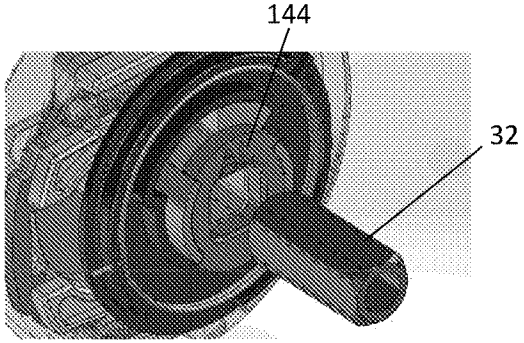
FIG. 26 shows an example coupling received by an example coupling receiver next to the latchbolt retractor actuator.
Figure 28:
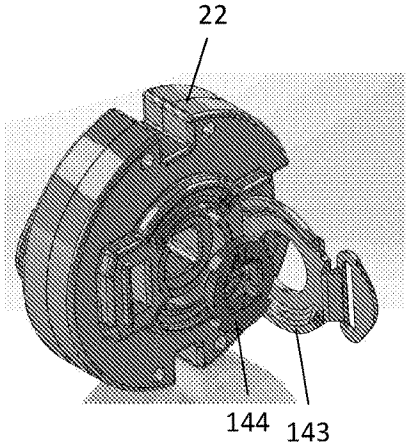

FIGS. 28 and 29 shows a coupling cage 143 of the latchbolt retractor 22 in an open state for receiving the example coupling 144 and the other example coupling 146.

Figure 31:
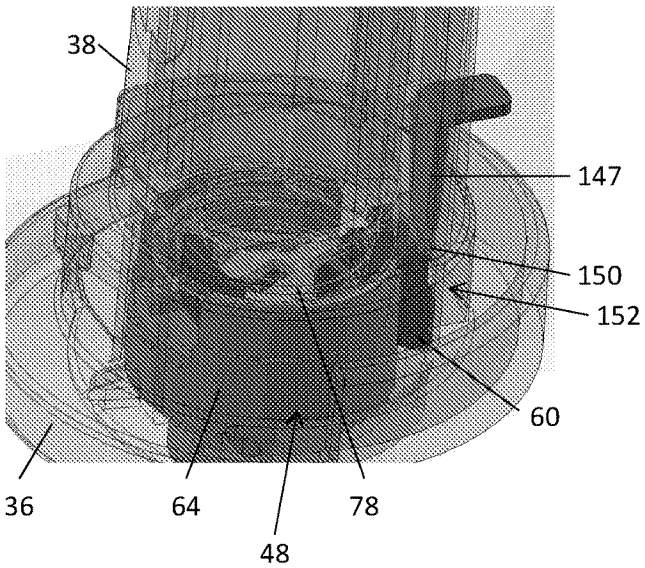
FIG. 31 shows a perspective view of the example clutch adaptor partially disassembled to reveal the other example cam of FIG. 20 and interacting with a removable retractable key stop in the handle coupler of FIG. 3.

FIG. 31 shows a perspective view of the clutch adaptor 48 received by the handle coupler 36 with the cam component 62 removed from the bearing component 64 to reveal the other cam component 78. The handle coupler 36, in this embodiment the shaft 38 of the handle coupler 36, is configured for receiving a removable retractable key stop 147 stop 147. The handle coupler 36 has a passageway in the form of a longitudinal passageway 148 (best seen in FIG. 6) in which the removable retractable key stop 147 is received. The passageway 148 has an opening 154 at the keyway 58. The passageway 148 has another opening 156 through which an end 150 of the removable key stop 147 is inserted. When the retractable key stop 147 is received by the passageway, the end 150 of the removable retractable key stop 147 is disposed within the keyway 58. The end 150 of the removable retractable key stop 147 interferes with the distal end 152 of the retractable key 60 to limit the outward extension of the retractable key 60.

Figure 32:
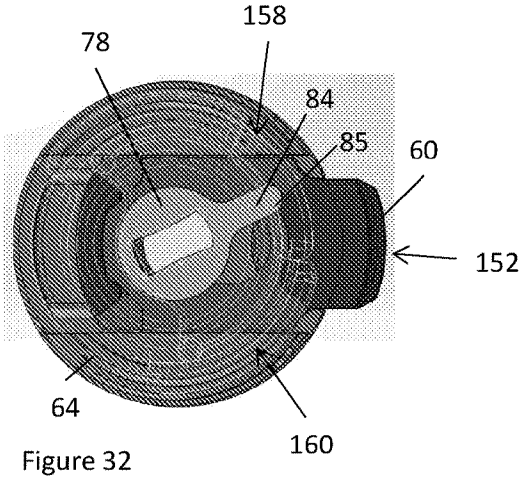
FIG. 32 shows a plan view of the partially disassembled example clutch adaptor of FIG. 31 showing the other example cam trapped at one side of the retractable key.

FIG. 32 shows a plan view of the partially disassembled clutch adaptor of FIG. 31 with the retractable key 60 extended as far as it would be if the retractable key stop 147 was interfering with the retractable key 60 to limit the outward extension of the retractable key 60. When the extension of the retractable key 60 is limited, the engagement surface 85 of the other cam component 78 is prevented from being rotated between opposite sides 158, 160 of the retractable key 60. That is, the engagement surface 85 of the other cam component 78 is trapped on one of the opposite sides 158, 160 of the retractable key 60 when the retractable key stop 147 is received by the handle coupler 36. The handle associated with the handle coupler 36 may be rotated either clockwise or anticlockwise to operate the latchbolt retractor 22, depending on which side of the hinged barrier the handle is located. The retractable key 60 is extended by the other cam component 78 when the locking actuator 90 is rotated in the opposite rotational direction as the handle is to operate the latchbolt retractor 22. Consequently, which side of the retractable key 60 the engagement surface 85 of the other cam component 78 should be located depends on which side of the door the associated handle is located. The engagement surface 85 of the other cam component 78 may be changed between opposite sides of the retractable key 60 as follows. In a step, the retractable key stop 147 is removed from the handle coupler 36. In another step, the other cam component 78 is rotated to locate the engagement surface 85 on a selected side of the retractable key 60. In yet another step, the retractable key stop 147 is received by the handle couple 36, limiting the outward extension of the retractable key 60 to prevent the engagement surface 85 of the other cam component 78 from being moved between the opposite sides 158, 160. Consequently, the engagement surface 85 of the other cam component 78 may be placed on the correct side of the retractable key as determined by which side of the door the associated handle is located.

While the passageways described herein may generally but not necessarily be in the form of a tunnel, however the passageways may be in the form of a slot, for example, or generally have any suitable form.

Figure 37:
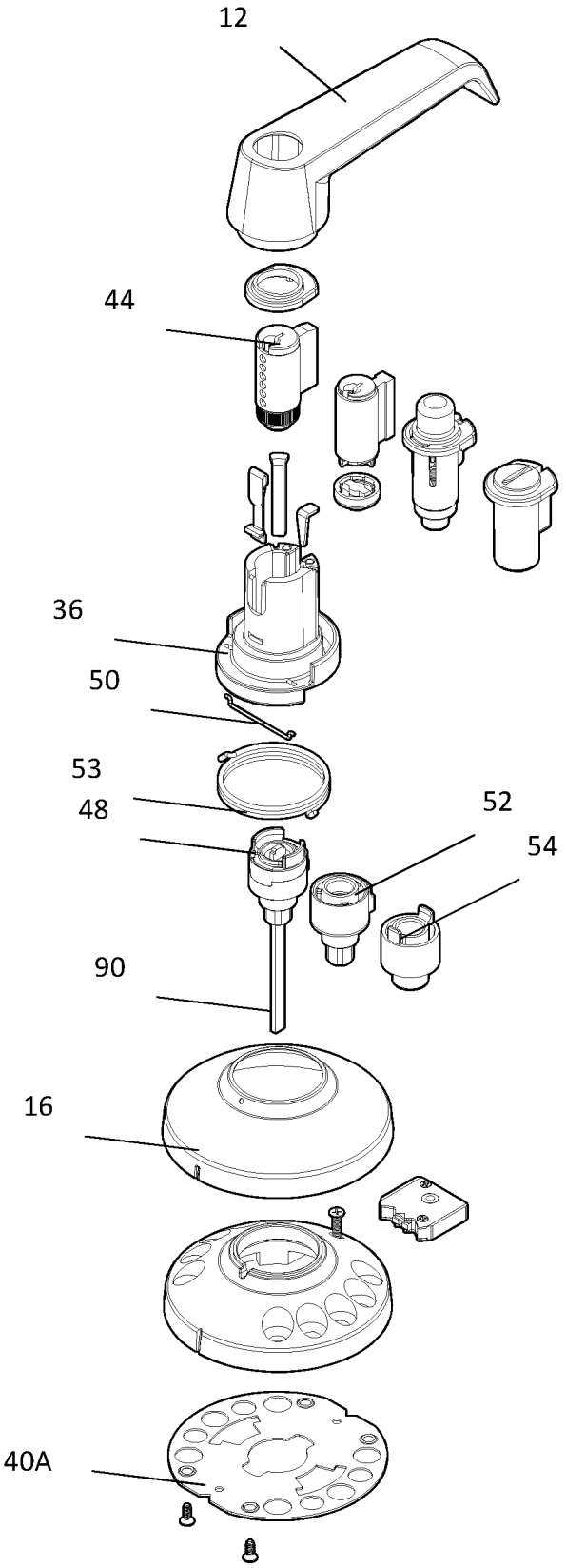
FIG. 37 shows an exploded view of an example handle and an example rose of the lockset of FIG. 2.

FIG. 37 shows an exploded view of a handle and a rose of another embodiment of a lockset, with alternative user locks and adaptors shown, wherein parts having similar form and/or function to those described are similarly numbered.

In alternative embodiments, the mechanism 30 only has one rotationally mounted handle coupler. This may be used, for example, in a lockset that only has one handle for one side of the hinged barrier but not the other. Features described with respect of the embodiment having a pair of rotationally mounted handle couples are generally, but not necessarily, features of at least some of the alternative embodiments.

FIGS. 38 to 50 relate to another embodiment of a mechanism 230 for another example of a lockset, where parts having similar form or function to those described above are similarly numbered with the addition of the prefix 2. The mechanism 230 functions similarly, but not identically, to the embodiments of FIGS. 1 to 37.

Figure 38:
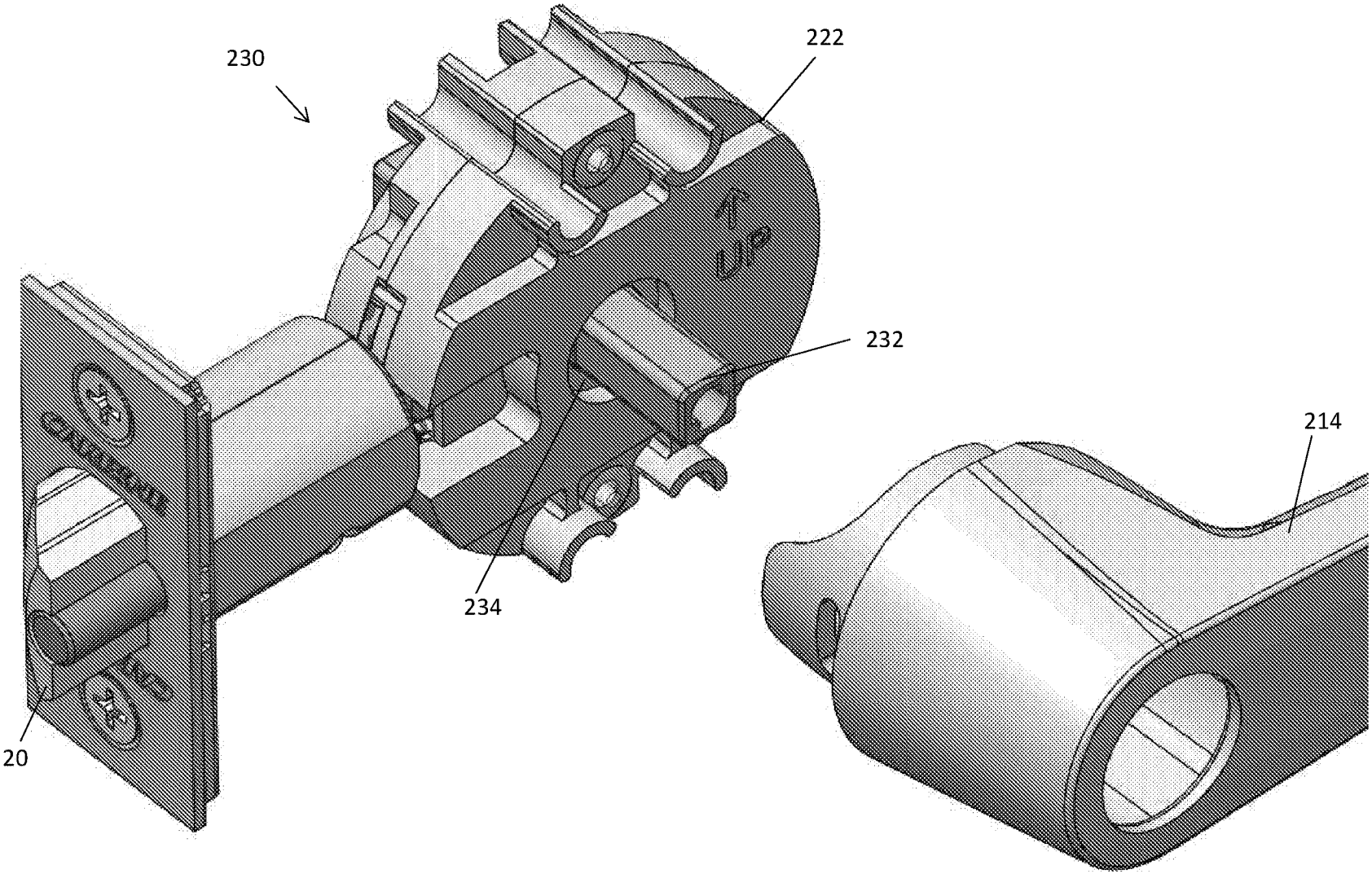
FIG. 38 shows an exploded perspective view of part of an another example mechanism for another example of a lockset.

FIG. 38 shows an exploded perspective view of part of a mechanism 230 for the lockset. The mechanism 230 comprises the latchbolt retractor 222, which is rotationally actuatable by a latchbolt retractor actuator 232 comprising a hollow bar 235. The hollow bar 235 has a rectangular, in this example square, lateral section with rounded or chamfered corners. The latchbolt retractor actuator 232 may take any suitable form, for example it may have a hexagonally shaped lateral section. The latchbolt retractor 222 has an actuator coupling 237 (best seen in FIG. 50) and configured to rotationally engage by interlocking the retraction mechanism actuator 232. The latchbolt retractor actuator 232 defines a passageway 233 through which in use the locking actuator 90 passes. The passageway is configured for lost motion of the locking actuator 290. In this particular embodiment, the passageway has a butterfly shape, although any suitable shape may be used. The locking actuator 290 can drive the latchbolt retractor actuator 232 in a vestibule function, wherein the latchbolt retractor 222 can be operated by key operation of a cylinder lock 44 coupled to the locking actuator 290, for example. Alternative methods that may be used to achieve lost motion include an oversized rectangular passageway or a key in an oversized keyway. Alternatively, the lost motion may be achieved using a dwell mechanism, for example a cam mechanism.

Figure 40:
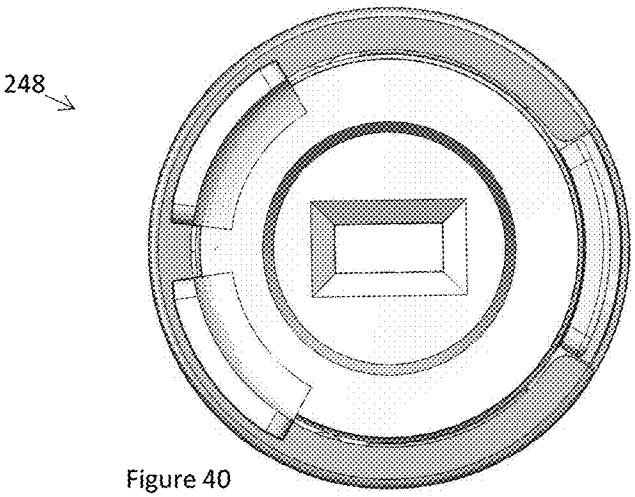
FIGS. 39 and 40 show an example clutch adaptor in alternative modes.
Figure 39:
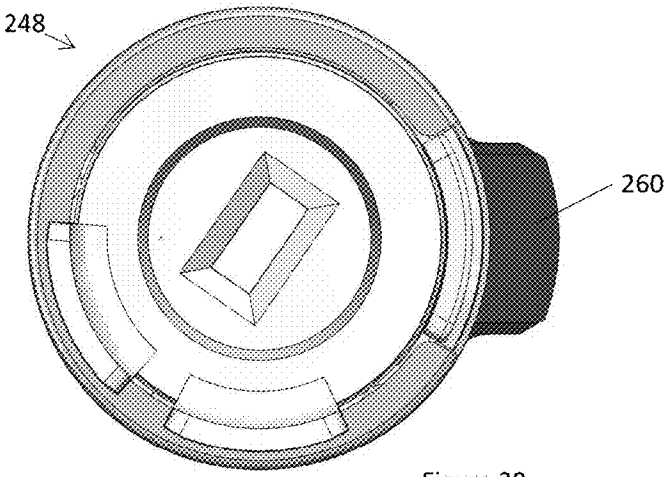
Figure 46:
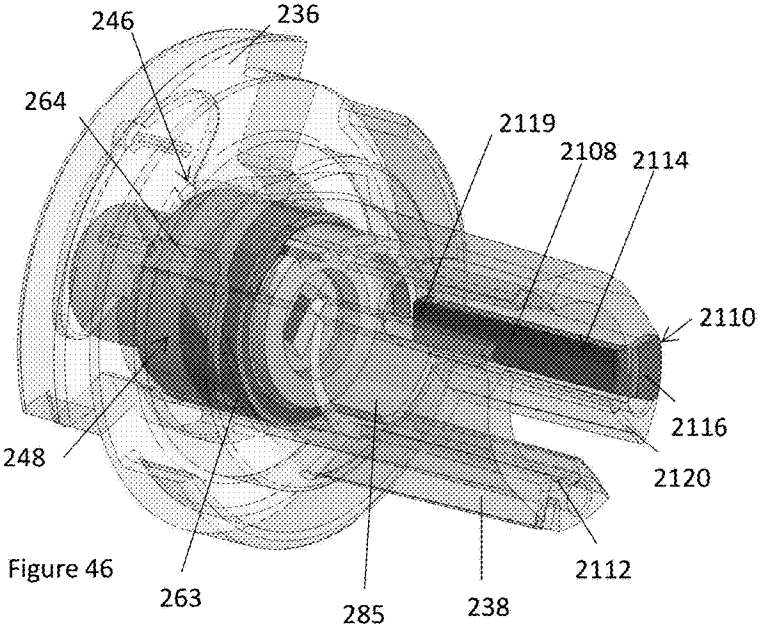
FIG. 46 shows a wire frame perspective view of a handle coupler of the example mechanism of FIG. 38.

The handle coupler 236, as illustrated in FIG. 46, may receive any one of a plurality of adaptors similar to adaptors 48, 52, 54. The plurality of adaptors comprises a clutch adaptor 248. FIG. 39 shows an elevation view the clutch adaptor 248 in one mode, and FIG. 40 shows the clutch adaptor of FIG. 39 in another mode in the same elevational view. The clutch adaptor 248 is operable to engage the adaptor receiver 246 while being received thereby for transmission of the rotation. The clutch adaptor 248 is also operable to disengage the adaptor receiver 246 while received thereby so that handle rotation is not transmitted. The clutch adaptor 248 in the one mode (FIG. 39) can interlock with the adaptor receiver 246. The clutch adaptor 248 has a retractable key 260 and is operable to outwardly extend the retractable key 260 and also operable to retract the retractable key. In the one mode, the retractable key 260 is extended to be received by the key way (on the far side of 236 in FIG. 46) so interlocking the clutch adaptor 248 to the adaptor receiver 246. In the other mode (FIG. 40), the retractable key 260 is retracted and so the clutch adaptor 248 is no longer interlocked with the adaptor receiver 246. In the other mode, the clutch adaptor 248 is freely rotatable within an inner bearing surface 263 of the adaptor receiver 246, without transmission of rotation between the clutch adaptor 248 and the adaptor receiver 246.

Figure 41:
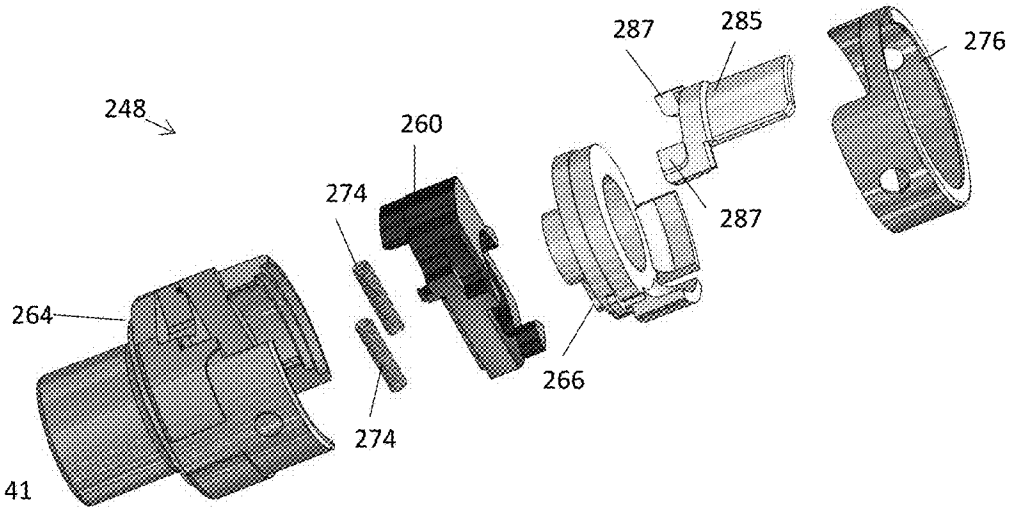
FIG. 41 shows an exploded perspective view of the clutch adaptor of FIGS. 39 and 40.
Figure 43:
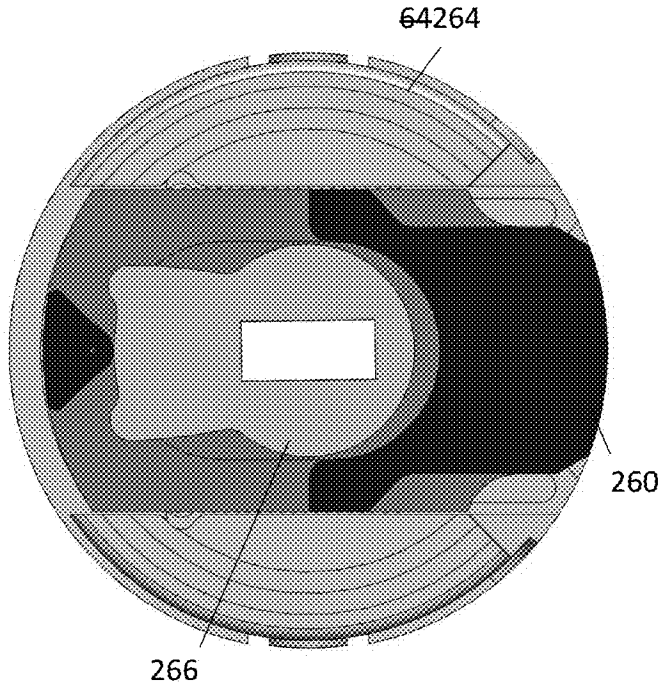
FIGS. 42 and 43 show respective underside and top perspective views of a cam component.
Figure 42:
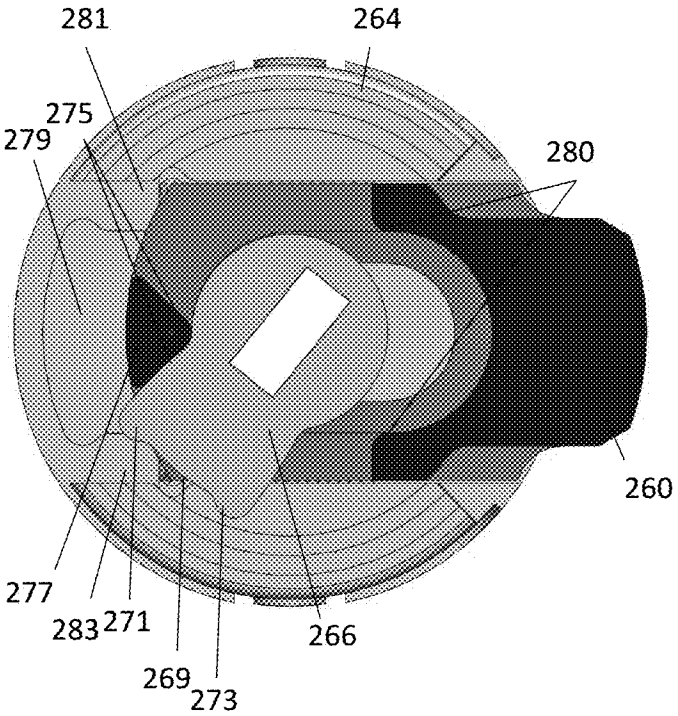
Figure 43B:
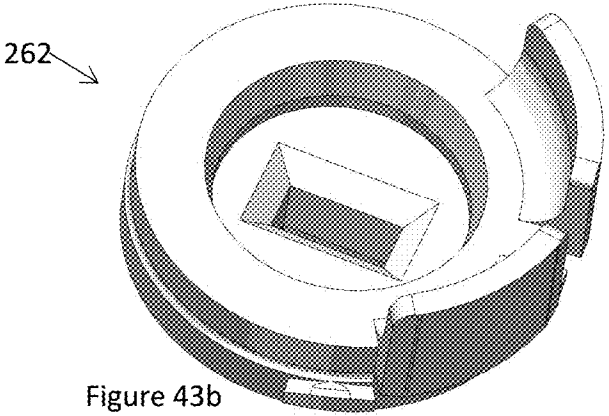
FIGS. 43*a* and 43*b* show different perspective views of a cam component.
Figure 43A:
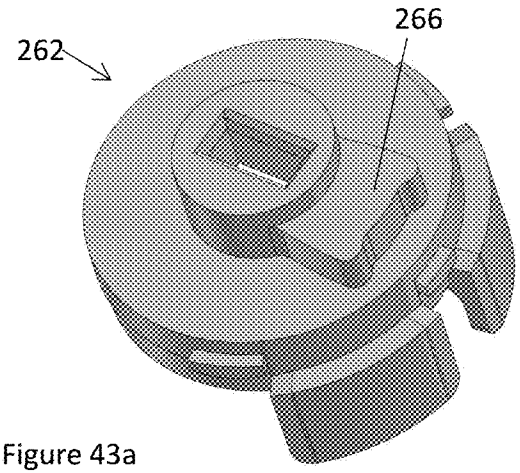

FIG. 41 shows an exploded view of the clutch adaptor 248. The clutch adaptor comprises a bearing component 264 on which the retractable key 260 is mounted. FIG. 42 shows a top view of the bearing component 264 with the retractable key 260 received thereby. The clutch adaptor 248 also has a cam component 262 configured to translate the retractable key 260 along the bearing component 264 when rotated relative to the bearing component 264, such that the retractable key 260 is driven inwardly along the bearing component. FIGS. 42 and 43 show respective underside and top perspective views of the cam component 262. FIGS. 42 and 43 show a plan view of the retractable key 260 received by the bearing component 264 and engaged with a cam comprising a cam plate 266 of the cam component 262. In this but not all embodiments, the cam 266 is integral with the cam component 262. When the cam component 262 is rotated relative to the bearing component 264, a bearing surface 269 of the cam plate 266 is followed by a bearing surface 275 of a lobe 277 of the retractable key 260. The cam plate 266 pushes the following bearing surface 275 when rotated to retract the retractable key 260.

The bearing surface 269 is delimited by a first bearing surface lobe 271 and a second bearing surface lobe 273. The retractable key lobe 277 in contact with the bearing surface 269 is confined, that is trapped, by the first lobe 271 and the second lobe 273, which maintains the retractable key in the retracted position. In this but not necessarily all embodiments, for lobe 275 to ride over either lobe 271 or 273, the retractable key 260 is first moved inwards.

Once the lobe 275 is outside the bearing surface 269 delimited by the first and second lobes 271 and 273, the biasing element 274 may then outwardly extend the key 260.

As shown in FIG. 41, the clutch adaptor 248 comprises at least one biasing element in the form of at least one compression spring 274, in this embodiment two parallel compression springs disposed adjacent opposite sides of the retractable key 260, although more than two compression springs may be used. One end of the compression springs engage the bearing component 264 and another end of the compression springs 274 engage with the retractable key 260 to outwardly bias the retractable key 260. Alternative embodiments may have an extension spring to outwardly bias the retractable key 260, a leaf spring, a block of resilient material for example a block of rubber, or generally any suitable biasing element. This arrangement may be reversed, wherein the retractable key is biased inward and the cam component is configured to drive the retractable key 260 outwardly.

Figure 45:
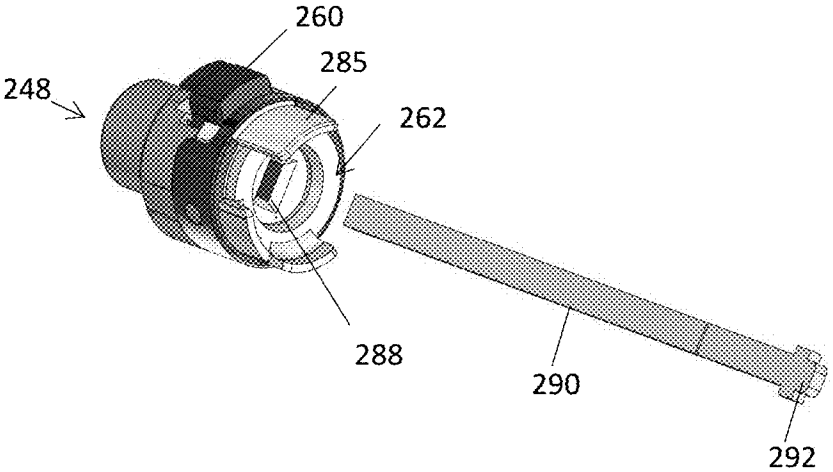
FIG. 45 shows a perspective view of one end of the clutch adaptor of FIGS. 39 and 40 and a locking actuator.
Figure 44:
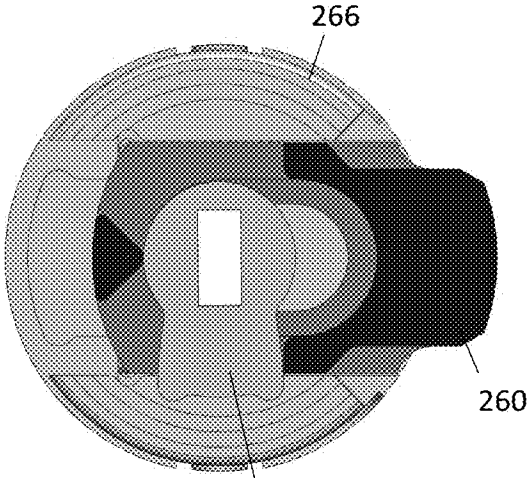
FIG. 44 show the example clutch adaptor of FIGS. 39 and 40 with some parts hidden.

Not shown in FIG. 41 is a locking actuator 290 that passes through the clutch adaptor 248. The locking actuator 290 is shown in FIG. 45, for example. The locking actuator 290 is operationally coupled to the user operated lock 44.

The retractable key 260 may be disengaged from the cam plate 266 by rotating the cam plate 266 so that the lobe 277 is beyond the bearing surface 269. When the retractable key 260 is so camingly disengaged from the cam plate 266, the at least one biasing element 274 extends the retractable key 260. The key 260 may not be translated outwardly until the retractable key 260 is aligned with (i.e. at) the keyway 258. The cam member 266 when sufficiently rotated cooperates with the other bearing surface 280 to outwardly extend the retractable key 260.

As shown in FIG. 41, the clutch adaptor 248 has a cap 276 configured to be fixed to the bearing component 264 to form a housing in which to contain the compression springs 274, and the retractable key 260. The clutch adaptor also comprises a stop receiver in the form of a longitudinally extending stop receiver 285. In this embodiment, the stop receiver 285 is removable attached. The stop receiver 285 is attached with clips 287 to the cap 276 and also attached to the bearing component 264.

FIG. 45 shows a perspective view of one end of the clutch adaptor 248 having the cam component 262. The cam component 262 defines a central slot 288 for receiving a locking actuator 290 in the form of a flat bar. In FIG. 45, the locking actuator 290 is shown removed from the adaptor 248. The flat bar 290 interlocks with the cam component 262 such that rotation is transmitted between the cam component 262 and the flat bar 290. The locking actuator in the form of the flat bar 290 is coupled to the user operated lock within handle 12. A distal end 292 of the locking actuator 90 is received within a butterfly slot defined by the user operated lock. Rotation is transmitted between the walls defining the butterfly slot of the user actuated lock and the locking actuator 290, between the locking actuator 290 and the cam component 262.

FIG. 46 shows a wire frame drawing of the handle coupler 236, with the clutch adaptor 248 received by the adaptor receiver 246 of the handle coupler 236. The key 260 is extended and so the lock is in an unlocked state. The handle coupler 236 has a stop 2108 configured for arresting a rotation of the bearing component 264, and which is in this embodiment removable. In the example shown in FIG. 46, the stop 2108 is for arresting rotation of the bearing component 264, but in an alternative embodiment it maybe for arresting rotation of the cam component 262.

The shaft 238 of the handle coupler 236 comprises a slot in the form of an inwardly flaring slot 2110 for securely receiving the stop 2108. The stop 2108 comprises an elongated tab 2114 and a distal end at which is attached an insertion stop 2116 for locating a proximal end 2119 of the stop 2108 at a predetermined position at the adaptor receiver 246. The bearing component 264 is attached to the stop receiver 285 for interference by the stop 2108 for arresting rotation of the bearing component. The insertion stop 2108 comprises a flange 2116 that when the stop 2108 is received abuts an end 2120 of the shaft 238 and which may function as a handle to facilitate insertion and removal of the stop 2108 by a user. In the present embodiment, but not necessarily in all embodiments, the shaft 238 has a plurality of slots 2110, 2112 for securely receiving the stop 2108. The stop 2108 may be inserted in any of the plurality of slots 2110, 2112 as suitable, depending on which side of the hinged barrier the handle coupler 236 is disposed. When the bearing component 264 has its rotation arrested by the stop 2108, rotation of the cam component by the latch bolt retraction actuator 290 results in the translation of the retractable key 260 along the bearing component 264. In this embodiment, the translation is an extension of the retractable key 260 along the bearing component 264.

The stop 2108 arrests tab 285, which may trap the tab 122 at a side of the handle coupler 236. When the clutch adaptor 248 is in the locked state and the key 260 is retracted, tab 285 is in contact with stop 2108.

Figure 47:
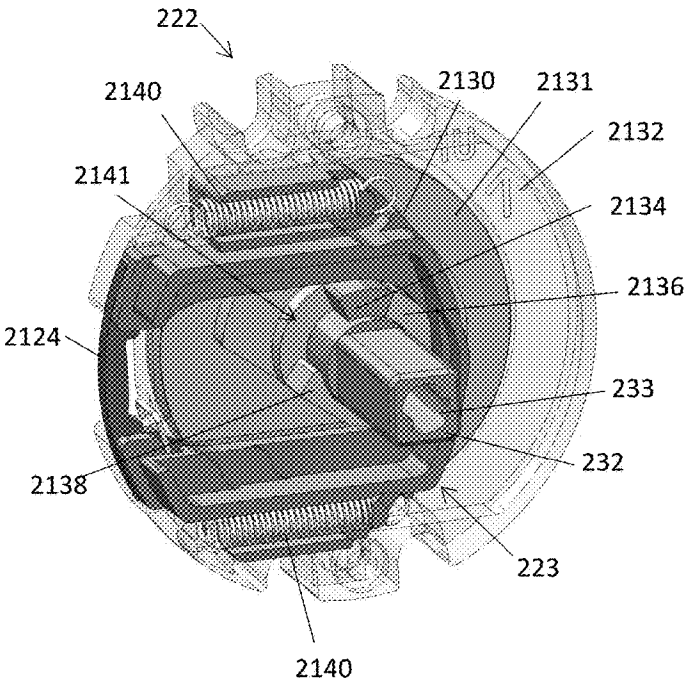
FIG. 47 shows a cutaway view of a latchbolt retractor for the mechanism of FIG. 38.
Figure 48:
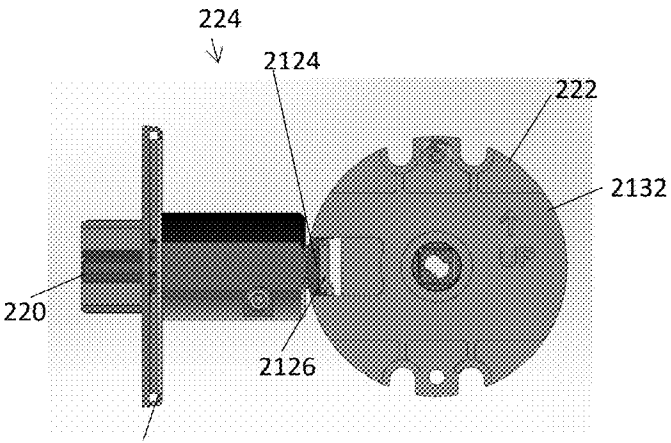
FIG. 48 shows an elevational view of the latchbolt retractor of FIG. 47 operationally coupled to a latch bolt assembly of FIG. 38.
Figure 49:
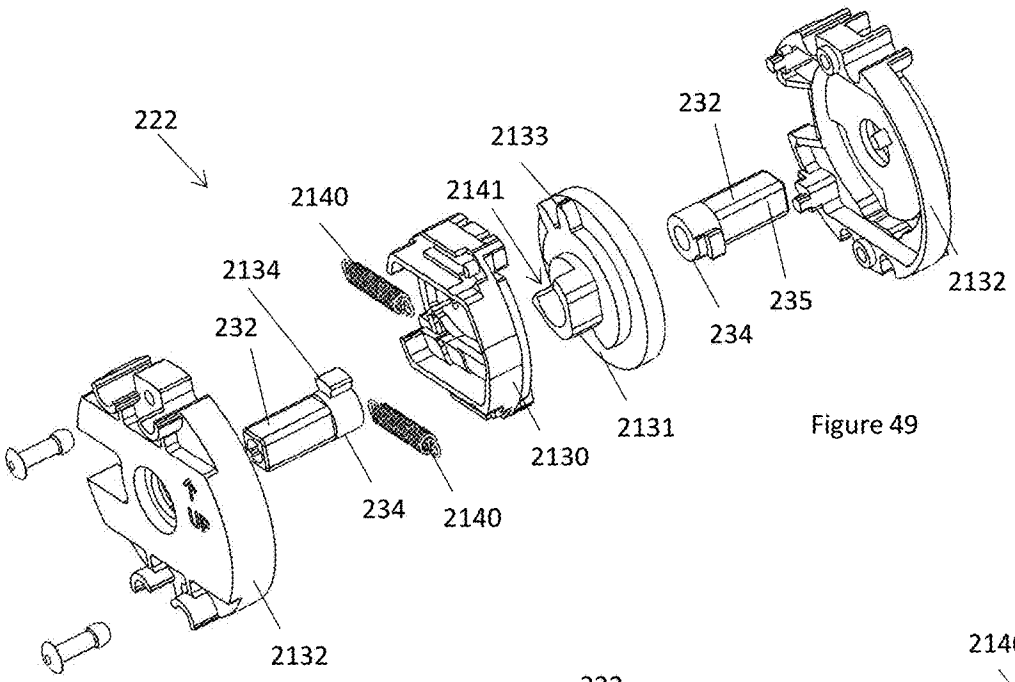
FIGS. 49 and 50 show exploded views of a latchbolt retractor of FIG. 47.
Figure 50:
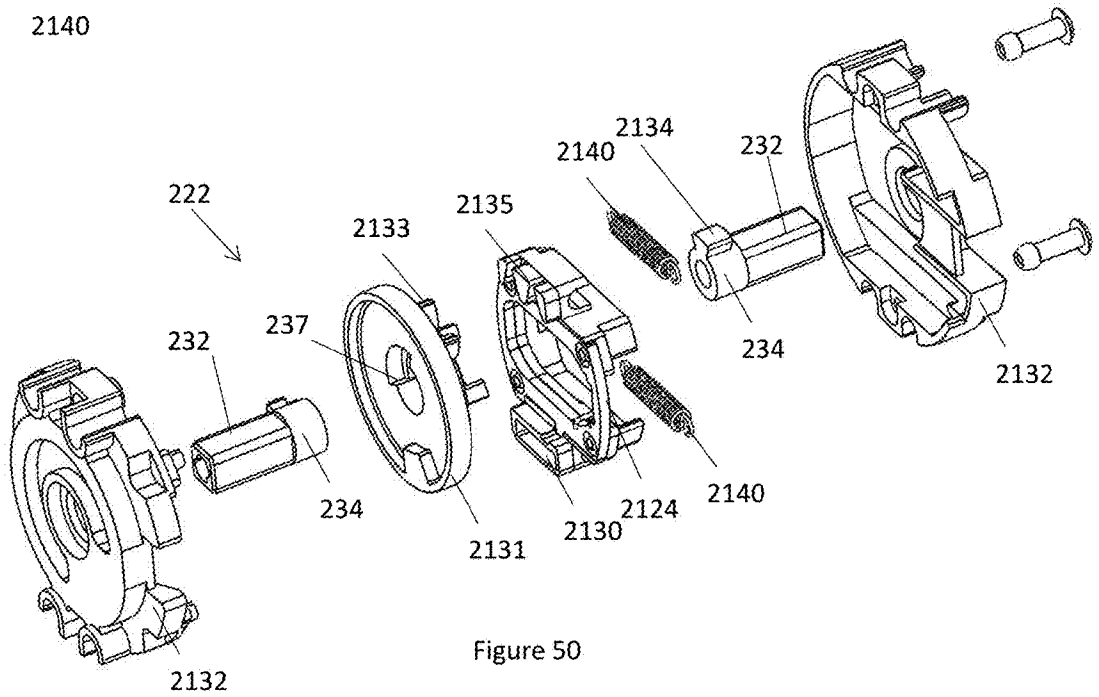

FIG. 47 shows a cutaway view of the latchbolt retractor 222. The latchbolt retractor 222 has a latch bolt assembly coupler 2124 in the form of a slotted plate. As shown in FIG. 48, the latch bolt assembly 224 has a hook 2126 at a proximal end thereof that in use is received by the slotted plate 2124. FIGS. 49 and 50 show exploded perspective views of the latch bolt retractor 222. The latchbolt retractor 222 comprises a latchbolt retraction mechanism 223 configured to retract the latchbolt 220 when the latchbolt retractor actuator 232 is rotated, but not rotate the latchbolt retractor actuator 232 when the latch bolt 220 is pushed inwards. The latchbolt retraction mechanism 223 comprises a carriage 2130 slidably mounted in the latch bolt mechanism housing 2132 and to which the latchbolt assembly coupler 2124 is attached. The slidably mounted carriage 2130 is outwardly biased by at least one biasing element in the form of an extension spring 2140. Alternatively, the biasing element may be a compression spring or generally any suitable form of biasing element, for example a leaf spring or an extension spring. The slidably mounted carriage 2130 is operationally coupled via a rack-and-pinion arrangement to plate 2131 having the pinion 2133 and housed in the latch bolt mechanism housing 2132 and mounted to rotate around an axis of rotation. The carriage 2130, which has the rack, is translated within the housing 2132 by rotation of the plate 2131 within the housing 2132. The actuator coupling 234 is in this but not all embodiments integral to the actuator 232 and is mounted to rotate around the axis of rotation, and has a flange 2134 located in an over-sized space 2141 between two flange engagers 2136, 2138 (see FIG. 47) operationally coupled to the pinion 2133 provide a degree of lost motion. Clockwise rotation of the actuator coupler 234 by rotation transmitted by the latchbolt retractor actuator 232 engages flange engager 2136 and further rotation is transmitted to the flange engager 2136 operating the plate 2131 which is followed by the carriage 2130, and the latchbolt assembly coupler 2124 with it. The rotationally biased handle coupler 236 turns the actuator coupler 234 via the latchbolt retractor actuator 232 when the handle is released, returning the flange 2134 to the default position shown in FIG. 47. Pushing the latch bolt 220 inwards, however, does not rotate the latch bolt retracting mechanism actuator 232 in view of the degree of lost motion provided by the oversized space 2141.

The three adaptors 48, 52, 54, can be inserted to the handle coupler to set whether that handle will always (adaptor 52, passage function), never (adaptor 54, vestibule function) or optionally (adaptor 48) operate the latchbolt retractor.

Now that embodiments have been described, it will be appreciated that some embodiments may have some of the following advantages:

An embodiment of a lockset may be adapted for any one of a plurality of functions, including the enabling or disabling of the handles and enabling or disabling of an anti-lockout function.

The roses and/or the handles may be changed as required for aesthetic or other reasons.

Variations and/or modifications may be made to the embodiments described without departing from the spirit or ambit of the invention. The present embodiments are, therefore, to be considered in all respects as illustrative and not restrictive.

Prior art, if any, described herein is not to be taken as an admission that the prior art forms part of the common general knowledge in any jurisdiction.

In the claims which follow and in the preceding description of the invention, except where the context requires otherwise due to express language or necessary implication, the word "comprise" or variations such as "comprises" or "comprising" is used in an inclusive sense, that is to specify the presence of the stated features but not to preclude the presence or addition of further features in various embodiments of the invention.

The invention claimed is:

1. A mechanism for a lockset comprising:

a latchbolt retractor that is rotationally actuatable; and a pair of rotationally mounted handle couplers, each of the pair is rotatable and comprises an adaptor receiver for receiving any one of a plurality of adaptors, each of the pair of rotationally mounted handle couplers being configured to engage with at least one of the plurality of adaptors, but not all of the plurality of adaptors, for transmission of the rotation, wherein the plurality of adaptors comprises a clutch adaptor operable to engage an adaptor receiver of the pair while being received thereby for transmission of the rotation and operable to disengage the adaptor receiver of the pair while being received thereby.

2. A mechanism defined by claim 1 wherein the clutch adaptor is operable to interlock with the adaptor receiver of the pair while being received thereby for transmission of the rotation of the handle.

3. A mechanism defined by claim 1 wherein the adaptor receiver comprises a keyway, and the clutch adaptor comprises a retractable key and is operable to outwardly extend the retractable key into the keyway and to retract the retractable key from the keyway.

4. A mechanism defined by claim 3 wherein the retractable key is biased.

5. A mechanism defined by claim 4 wherein the retractable key is one of outwardly biased and inwardly biased by at least one biasing element.

6. A mechanism defined by claim 5 wherein the at least one biasing element comprises at least one compression spring.

7. A mechanism defined by claim 3 wherein the clutch adaptor comprises a bearing component on which the retractable key is mounted and a cam component configured to translate the retractable key along the bearing component when rotated relative to the bearing component.

8. A mechanism defined by claim 7 wherein the cam component is configured to inwardly drive the retractable key along the bearing component when rotated relative to the bearing component.

9. A mechanism defined by claim 7 wherein the retractable key is biased in a direction counter to the translation by the cam component.

10. A mechanism defined by claim 7 wherein at least one of the pair of rotationally mounted handle couplers comprises a stop configured for arresting the rotation of one of the bearing component and the cam component, the bearing component being operationally coupled to a latchbolt retractor actuator, whereby when the rotation of the one of the bearing component and the cam component is so arrested, rotation of the other one of the bearing component and the cam component camingly disengages the retractable key from the cam component so that the retractable key can be translated in a direction counter to the translation by the cam component.

11. A mechanism defined by claim 10 wherein the stop is a removable stop.

12. A mechanism defined by claim 7 wherein one of the cam component and the bearing component is configured to be coupled to a locking actuator operationally coupled to a user operated lock, and the other one of the cam component and the bearing component is configured to be operationally coupled to a latchbolt retractor actuator.

13. A mechanism defined by claim 12 wherein the cam component is configured to be coupled to the locking actuator operationally coupled to the user operated lock, and the bearing component is configured to be operationally coupled to the latchbolt retractor actuator.

14. A mechanism defined by claim 7 wherein the retractable key has a bearing surface and the cam component is configured to cooperate with the bearing surface to inwardly translate the retractable key.

15. A mechanism defined by claim 7 wherein the retractable key is outwardly biased and the cam component comprises a cavity between two lobes followed by a bearing surface of the retractable key, the cavity being configured to receive the bearing surface of the retractable key for caming disengagement of the retractable key from the cam component and outward extension of the retractable key by the outward bias.

16. A mechanism defined by claim 12 wherein the locking actuator comprises a bar.

17. A mechanism for a lockset comprising:

a latchbolt retractor that is rotationally actuatable; and a rotationally mounted handle coupler, the rotationally mounted handle coupler being rotatable by a rotation and comprising an adaptor receiver for receiving any one of a plurality of adaptors, the rotationally mounted handle coupler being configured to engage with at least one of the plurality of adaptors, but not all of the plurality of adaptors, for transmission of the rotation, wherein the plurality of adaptors comprises a clutch adaptor comprising a retractable key and is operable to outwardly extend the retractable key to interlock the clutch adaptor and the adaptor receiver while being received thereby for transmission of the rotation, and the clutch adaptor is operable to retract the retractable key to disengage the adaptor receiver while the clutch adaptor is received thereby.

18. A kit comprising:

a latchbolt retractor that is rotationally actuatable; and a rotationally mounted handle coupler that is rotatable by a rotation and comprising an adaptor receiver for receiving any one of a plurality of adaptors, the rotationally mounted handle coupler being configured to engage with at least one of the plurality of adaptors, but not all of the plurality of adaptors, for transmission of the rotation, wherein the plurality of adaptors comprises a clutch adaptor comprising a retractable key and is operable to outwardly extend the retractable key to interlock the clutch adaptor and adaptor receiver while being received thereby for transmission of the rotation, and the clutch adaptor is operable to retract the retractable key to disengage the adaptor receiver while the clutch adaptor is received thereby.

* * * * *